US008033276B1

(12) United States Patent
Gabrel

(10) Patent No.: US 8,033,276 B1
(45) Date of Patent: Oct. 11, 2011

(54) PROJECTILE LAUNCHER WITH REDUCED RECOIL AND ANTI-JAM MECHANISM

(75) Inventor: Stanley Gabrel, Round Lake, IL (US)

(73) Assignee: Tippman Sports, LLC, Fort Wayne, IN (US)

( * ) Notice: Subject to any disclaimer, the term of this patent is extended or adjusted under 35 U.S.C. 154(b) by 658 days.

(21) Appl. No.: 12/102,535

(22) Filed: Apr. 14, 2008

Related U.S. Application Data

(60) Provisional application No. 60/911,689, filed on Apr. 13, 2007, provisional application No. 60/911,782, filed on Apr. 13, 2007, provisional application No. 60/981,287, filed on Oct. 19, 2007, provisional application No. 61/029,562, filed on Feb. 28, 2008.

(51) Int. Cl.
*F41B 11/32* (2006.01)

(52) U.S. Cl. ..... 124/73; 124/75

(58) Field of Classification Search ..... 124/70, 124/71, 72, 73, 60, 61, 75
See application file for complete search history.

(56) References Cited

U.S. PATENT DOCUMENTS

| | | | | |
|---|---|---|---|---|
| 5,462,042 | A * | 10/1995 | Greenwell | 124/76 |
| 6,601,780 | B1 * | 8/2003 | Sheng | 239/337 |
| 7,299,796 | B2 * | 11/2007 | Kirwan | 124/71 |
| 7,520,275 | B2 * | 4/2009 | Long | 124/73 |
| 7,527,049 | B2 * | 5/2009 | Sheng | 124/73 |
| 7,533,663 | B2 * | 5/2009 | Gan | 124/70 |
| 2003/0221684 | A1 * | 12/2003 | Rice | 124/71 |
| 2007/0163561 | A1 * | 7/2007 | Gan | 124/72 |
| 2007/0163562 | A1 * | 7/2007 | Gan | 124/73 |
| 2007/0163564 | A1 * | 7/2007 | Gan | 124/73 |
| 2008/0011283 | A1 * | 1/2008 | Lai | 124/73 |
| 2008/0121220 | A1 * | 5/2008 | Wilder et al. | 124/77 |
| 2009/0283086 | A1 * | 11/2009 | Lian | 124/76 |
| 2010/0012109 | A1 * | 1/2010 | Lai | 124/77 |
| 2010/0051008 | A1 * | 3/2010 | Lian | 124/73 |
| 2010/0154767 | A1 * | 6/2010 | Masse | 124/77 |

* cited by examiner

*Primary Examiner* — Benjamin P Lee
(74) *Attorney, Agent, or Firm* — Barnes & Thornburg LLP

(57) ABSTRACT

A projectile launcher having a pneumatic assembly that reduces recoil. The launcher may include a gas storage chamber that is filled with compressed gas and then selectively vented to propel projectiles. In some cases, an electronic control circuit may be provided to selectively vent the gas storage chamber. In some embodiments, the launcher may include an anti jam feature that reduces breakage of projectiles during firing.

27 Claims, 36 Drawing Sheets

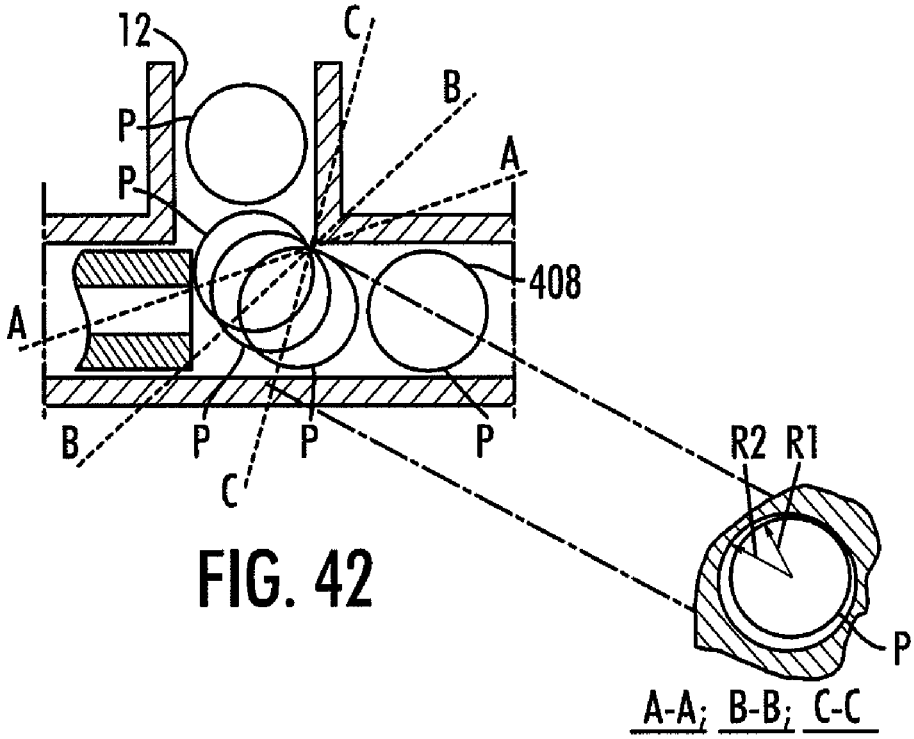
FIG. 42
FIG. 42A
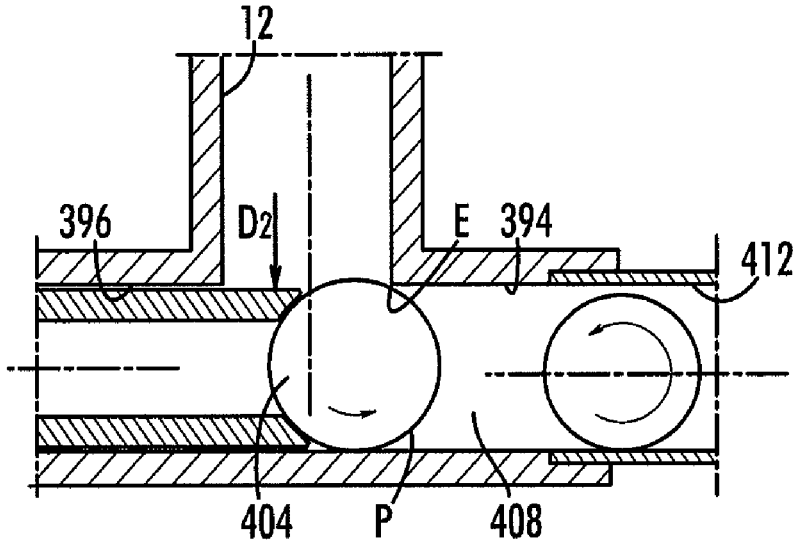
FIG. 43

PROJECTILE LAUNCHER WITH REDUCED RECOIL AND ANTI-JAM MECHANISM

RELATED APPLICATIONS

This application claims priority to U.S. Provisional Application Nos. 60/911,689, 60/911,782, 60/981,287, and 61/029,562 filed Apr. 13, 2007, Apr. 13, 2007, Oct. 19, 2007, and Feb. 28, 2008, respectively. The entire disclosures of these applications are hereby incorporated by reference.

TECHNICAL FIELD

This invention generally relates to compressed gas powered projectile launchers, such as paintball markers (also known as paintball guns). In particular, the invention relates to a projectile launcher having a firing mechanism with reduced recoil. In some cases, the invention provides an anti-jam feature that reduces chopping or shearing of projectiles during firing.

BACKGROUND

Devices that fire frangible projectiles are known in the art. For example, paintball markers are used for marking in forestry and cattle ranching. Paintball markers have also become popular in a variety of targeting and simulated battle games (e.g., capture the flag). In some cases, law enforcement employs markers to aid in crowd control and other situations where less-than-lethal force is desired.

The markers launch a projectile typically using compressed gas, such as carbon dioxide or nitrogen. Compressed gas is supplied from a supply tank which is typically mounted to or carried with the marker. In some cases, the markers may be equipped with pressure regulators, which receive compressed gas at a relatively high pressure and deliver the gas at a reduced, more consistent pressure for propelling the projectile.

There are two main types of markers presently on the market. One type uses a hammer with a tripping mechanism to strike a firing valve, where part of the compressed gas is used to propel the projectile and another portion of the gas is used to return the hammer to a ready-to-fire position (i.e., "recock" the marker). This type of design causes kickback or recoil when recocking the marker.

The second type of marker includes a spool valve where the marker's bolt is utilized as a spool valve with sealing members placed on it. A disadvantage of this arrangement is that sealing members are the size of the bolt and require significant force to jump start bolt movement under pressure. Also, the lubrication state of O-rings effects velocity of the bolt. If the o-rings are dry, a large force is needed to move the spool-bolt combination forward to load the paintball into the barrel, which can cause paintball breakage. To reduce paintball breakage, soft o-rings with a very small squeeze are being used. This leads to another problem when using carbon dioxide ("$CO_2$") as a source of energy, because during rapid firing liquid $CO_2$ imbeds with the sealing members, resulting in a loss of elasticity and leaks. Other pneumatic markers include complicated firing mechanisms. Drawbacks of these more complicated mechanisms include operating difficulty, frequent maintenance issues, and high manufacturing cost.

Another common problem with existing markers is breakage or rupturing of the frangible projectiles. The frangible projectiles commonly have a gelatinous or plastic shell designed to break upon impact. Typically, the shells are filled with a marking material, such as paint, and/or an immobilizing material, such as a noxious chemical. Projectiles drop by gravity force from a hopper (or are otherwise fed) into the marker's breech chamber. Typically, the firing mechanism includes a bolt that pushes the projectile into the barrel when the user pulls the trigger. In some cases, however, the projectiles become partially inserted into the breech chamber. When this happens, the bolt tends to chop or shear the projectile, which fouls the marker's breech chamber and barrel.

Existing markers have a cylindrical feed tube disposed usually on the top portion of the marker and perpendicular to the barrel. The upper portion of the feed tube is typically connected to a hopper. Since the feed tube has a cylinder extending into another cylinder formed inside the breech chamber, intersecting curves (rays) exist when viewed in three dimensional object geometry. The opening cavity of breech chambers in existing markers is made by using a ball end-mill, which is cylindrical in shape. The end mill has end flutes that are formed in a circular configuration, and when plunged into a solid material will form half of the sphere extending into a cylinder as shown in FIG. 37. In this particular case, the ball end mill plunges into the breech chamber body until it reaches the lowest point of the internal cylindrical surface of the breech chamber, where the cylindrical surface of the breech chamber is the extension of the barrel's cylindrical bore.

From a three dimensional geometry standpoint, this results in an intersection of two cylinders and the intersection of a cylinder with half of the sphere. The intersection of two cylinders results in elliptically-shaped curves. The intersection of a cylinder with a sphere has a parabolic curve in one of the views. In the scenario presented above, the projectile needs to drop all the way down to the point where the center of the projectile lies within the breech cylinder symmetrical line, which is an extension of the barrel's internal bore for loading the projectile to be fired. In a case when the projectile feed is provided by gravitational force, many times during rapid firing projectiles do not reach the point of readiness to be loaded into the barrel. Instead, the projectiles are still falling when the sliding bolt forces the projectile into the firing chamber through the elliptical/parabolic intersecting lines which are smaller in width than the diameter of the projectile causing paintball breakage.

Another common problem encountered with firing projectiles is accuracy. For example, paintball manufacturing often results in paintballs that are not perfectly round and can have significant variability in average diameter. Without wishing to be bound by a particular theory, Applicant believes this causes paintballs to start spinning during the loading operation into the firing chamber. Rotations of the paintballs are then further promoted when compressed gas is applied to fire the paintball. Applicant believes that excessive paintball rotation causes undesirable variation in trajectory (similar to how a soccer player tries to impart a curve in the ball path to avoid a goalie).

It therefore would be desirable to provide a novel projectile launcher that reduces recoil and paintball breakage.

SUMMARY

According to one aspect, the invention provides an apparatus for propelling a projectile with compressed gas. The apparatus includes a barrel, a compressed gas source, and a body coupled with the barrel. The body defines a gas storage chamber adapted to be in fluid communication with the compressed gas source and hold a predetermined volume of compressed gas. In some cases, the apparatus may include a hopper configured to provide a supply of projectiles to the body. A valve arrangement is provided that is movable between a ready-to-fire position that allows fluid communication between the gas storage chamber and the compressed gas source and a firing position that vents gas from the gas storage chamber to propel projectiles through the barrel. When in the firing position, the valve arrangement prevents fluid communication between the gas storage chamber and the compressed gas source. A firing mechanism, such as a trigger, is provided to move the valve arrangement from the ready-to-fire position to the firing position. In some embodiments, the valve arrangement moves between the ready-to-fire position and the firing position responsive to an electronic control circuit.

In one illustrative embodiment, the gas storage chamber may vent into a firing tube. For example, when in the ready-to-fire position, the valve arrangement could include a valve, such as a spool valve, with a distal end that prevents venting of the gas storage chamber into the firing tube. Typically, the valve's distal end may be sealed in some manner. By way of example, the distal end could include a face seal or an O-ring. Embodiments are contemplated in which an O-ring could be disposed within the firing tube and the distal end could extend into the firing tube when the valve arrangement is in the ready-to-fire position.

Depending on the exigencies of a particular application, the apparatus could include a volume adjustment mechanism that controls the volume of gas with which projectiles are propelled out of the barrel. In some embodiments, for example, a wall defining at least a portion of the gas storage chamber could be movable to adjust a volume of compressed gas that can be held within the gas storage chamber. Typically, the wall is movable substantially along a longitudinal axis of the body.

According to another aspect, the invention provides a method for propelling a projectile using compressed gas. The method may include the step of providing an apparatus adapted to propel projectiles using compressed gas. Typically, the apparatus would be configured to propel projectiles responsive to actuation of a trigger. The fluid communication between a compressed gas source and a gas storage chamber disposed within the apparatus is maintained until a user actuates the trigger. The gas storage chamber is vented responsive to actuation of the trigger. In most cases, the fluid communication between the compressed gas source and the gas storage chamber is prevented while the trigger is being actuated. Embodiments are contemplated in which the method includes the step of moving a wall defining the gas storage chamber to adjust a volume of gas with which projectiles are propelled from the apparatus.

In some illustrative embodiments, a projectile path from a feed port to the barrel includes an elbow-shaped portion. For example, a breech chamber could be free from intersecting lines created during a manufacturing process. In some cases, the breech chamber may be larger than an internal bore of the barrel.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The present disclosure will be described hereafter with reference to the attached drawings which are given as non-limiting examples only, in which:

FIG. 42 is a cross sectional view of the breech chamber according to present invention and shows paintball being loaded into the firing chamber with improved entry path to reduce paintball breakage in case the paintball does not reach the bottom surface of the breech cavity.

FIG. 42A illustrates a consistent vertical cross-sectional view taken along the planes A-A, B-B and C—C in FIG. 42.

FIG. 43 is a cross sectional view of the breech chamber according to the present invention and shows a paintball being loaded into the firing chamber through the improved entry area to reduce paintball spinning.

Corresponding reference characters indicate corresponding parts throughout the several views. The exemplification set out herein illustrates embodiments of the invention, and such exemplification is not to be construed as limiting the scope of the invention in any manner.

DETAILED DESCRIPTION OF THE DRAWINGS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
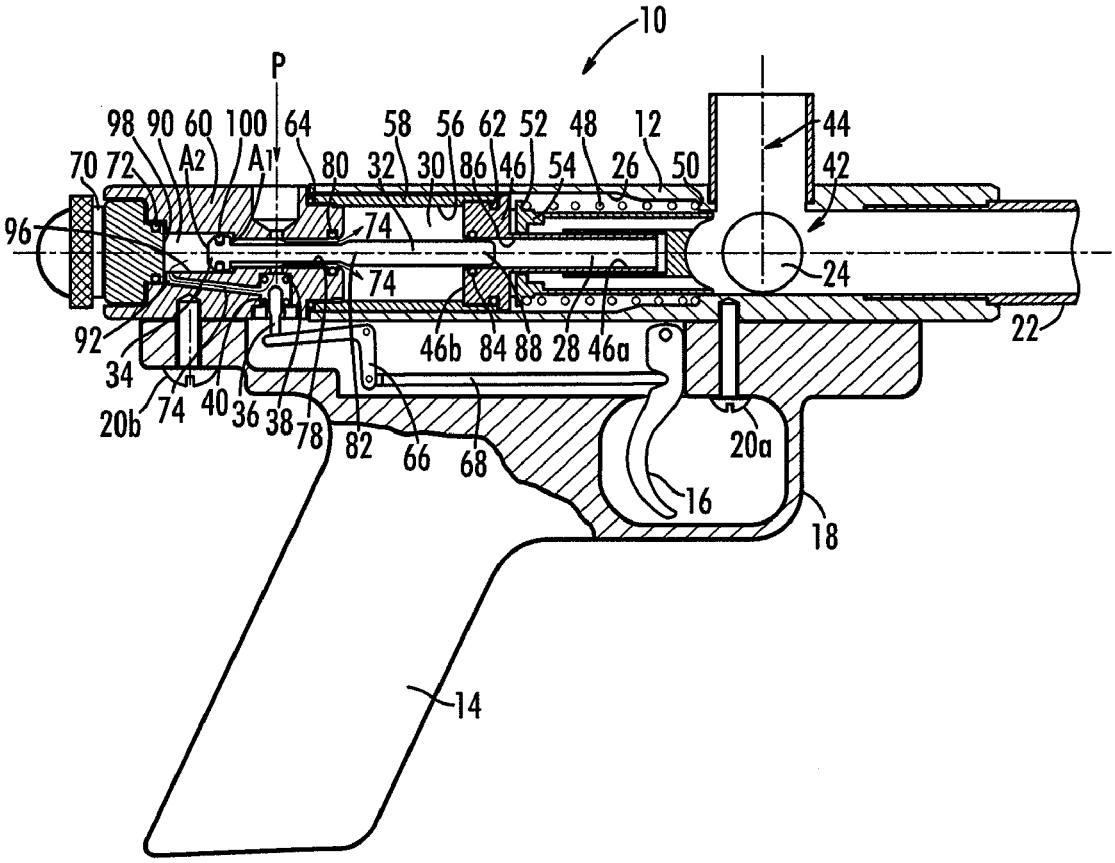
FIG. 1 is a side elevation view partially in cross-section of a projectile launcher according to an embodiment of the present invention and shows the launcher in ready to fire position.
Figure 2:
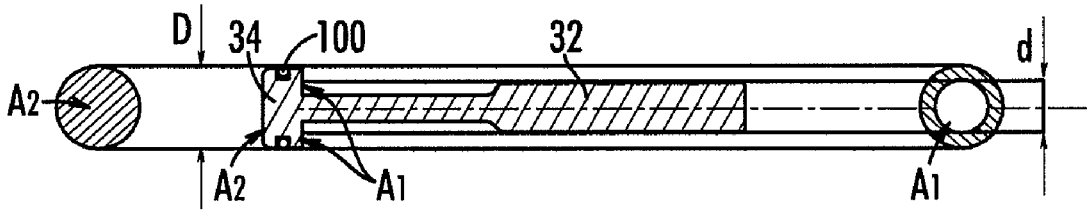
FIG. 2 is a cross-sectional view of the spool valve illustrating first and second surface areas of the spool valve piston.

FIG. 1 shows a projectile launcher, generally referred to by reference number 10, constructed according to an embodiment of the present invention. While the subject invention is discussed herein in the context of a paintball marker, it should be appreciated that the projectile launcher 10 could be adapted to launch other types of non-lethal projectiles, such as spark balls, Pepperballs™ or other frangible projectiles filled with liquids, powders or other substances. The principles of the invention could also be adapted to devices for firing other types of non-lethal projectiles, such as BBs, pellets, air-soft pellets, darts, etc.

In the embodiment shown, the projectile launcher 10 includes a body 12 with a grip portion 14. As shown, the grip portion 14 is coupled to the body 12 with screws 20*a* and 20*b*. It should be appreciated that other fastening devices, such as pins, clips, latches, etc., could be used to couple the grip portion 14 with the body 12. In some cases, the grip portion 14 and body 12 could be formed as a single, unitary member. A pivotally mounted trigger 16 is disposed within a trigger guard 18. The user would pull the trigger 16 to activate firing of the projectile launcher 10. A barrel 22 extends from the body 12. As shown, the barrel is secured to the body 12 with threads, but could be secured using an interference fit, frictional fit, or other connection. The barrel 22 includes a bore through which a projectile 24, such as a paintball, is propelled during firing.

In this embodiment, a pneumatic assembly is disposed inside a bore 26 defined in the body 12. As shown, the pneumatic assembly comprises a bolt assembly 28, a firing mechanism with a gas storage chamber 30, a pneumatic assembly having a spool valve 32 with a piston 34, and several sealing members to control gas communication inside the pneumatic assembly. The pneumatic assembly is activated by a flow valve secured within the body 12 and is equipped with control valve 36 with valve stem 37 and seal members 38 and 40 spaced apart from each other.

In this example, the projectile 24 enters a breech chamber 42 from a projectile inlet 44. In other examples, the projectile launcher 10 may include an integral magazine for feeding projectiles into the breech chamber 44. The bolt assembly 28 is received into the front portion of the bore 26 and cooperates with a firing tube 46 and the barrel 22. A biasing member 48 is disposed in the bore 26 between a seat member 50 and a dog portion 52 of a bolt 54. In this embodiment, the biasing member 48 urges the bolt 54 to a ready-to-fire position. As shown, the bolt 54 is cylindrical in shape and is slidably mounted circumjacent to a portion of the firing tube 46.

In this illustrative embodiment, the gas storage chamber 30 is defined by a bore 56 in a sleeve member 58, a portion of the firing tube 46, a manifold 60, and the spool valve 32. The firing tube 46 and manifold 60 are adapted for placement within the bore 56 and threadedly engaging into the sleeve member 58. O-rings 62 and 64 (or other types of seals) prevent gas from escaping to the atmosphere.

The spool valve 32 is slidably mounted within the gas storage chamber 30 and manifold 60 and is capable of movement between a forward position and rearward position, where these positions correspond to a ready-to-fire and firing position, respectively. The valve pin 36 is operatively coupled with a lever 66, a connecting link rod 68 and the trigger 16. An end cap 70, which screws into the manifold 60 in this embodiment, serves as a stop to limit rearward movement of the spool valve 32. As shown, an O-ring 72 placed on the end cap 70 prevents compressed gas from escaping to the atmosphere.

In the embodiment shown, compressed gas enters the projectile launcher 10 from a gas source (not shown) at a preselected pressure through an entry port P. Although the entry port P is on top of the manifold 60 in the embodiment shown, it could be on the bottom or on a side (or other desired location). The gas storage chamber 30 is filled with compressed gas through a passageway 74 with communication of a circumferential recess 76 and a bore 78. The circumferential recess 76 permits gas flow to fill the gas storage chamber 30 in the ready-to-fire position, because the seal member 80 is unsealed from spool valve portion 82. In the embodiment shown, the seal member 84 prevents gas from discharging to internal bore 86 of firing tube 46 by sliding forward end 88 of the spool valve 32 into seal member 84 placed inside a valve body (firing tube) 46. As discussed below with respect to FIGS. 16A-18B, several embodiments are contemplated in which the gas storage chamber 30 could be sealed in the ready-to-fire position.

At the same time, a sub chamber 90 is filled with compressed gas through the bore 78 and a passageway 74, where the passageway 74 is formed by a canal 92. O-ring 40 with cooperation from the valve pin 36 prevents gas from escaping to the atmosphere. The force from compressed gas generated on the face surface of the valve pin 36 biases the valve pin 36 down towards the grip portion 14 creating the passageway 74. This also resets the trigger 16 to the ready-to-fire position through mechanical linkage of the lever 66 and link rod 68. Other arrangements can be provided where a valve pin 36 is directly activated by a portion of the trigger 16, as discussed below. The piston 34 may be integrated into or linked with the spool valve 32. One side of the piston 34 has a surface area A1, which receives continuous supply of compressed gas from the gas source. The other side has a surface area A2 partially defining sub chamber 90 and receives selective supply of compressed gas. As shown, the sub chamber 90 is also defined by a cylindrical section 96 formed inside the manifold 60 and a wall 98 of the end cap 70. A seal member 100 prevents gas communication between the two piston sides.

Figure 4:
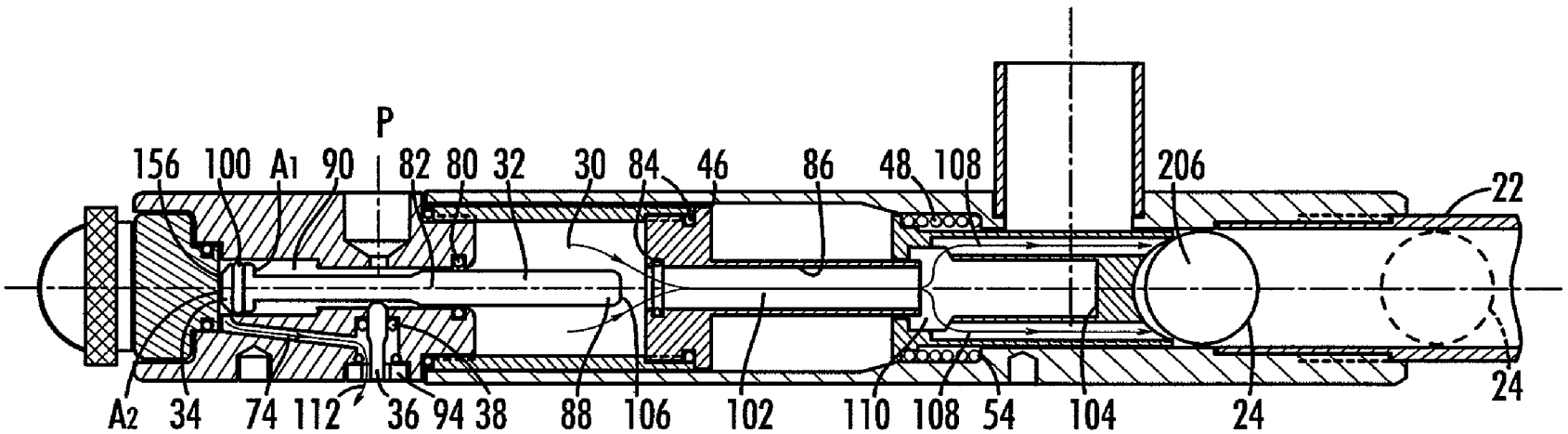
FIG. 4 is a cross-sectional view of the gun in the firing position.

When the trigger 16 is pulled, the valve pin 36 will move due to the mechanical linkage of the link rod 68 and lever 66 to the position shown in FIG. 4. This results in closing access of the compressed gas from the port P to sub chamber 90 with seal member 38 and then venting compressed gas from sub chamber 90 to the atmosphere. An absence of compressed gas in the sub chamber 90 will result in a loss of force on the piston 34 at the surface area A2. The remaining opposing force coming from the compressed gas pressure being applied at the surface area A1 will bias the spool valve 32 to the firing position as shown in FIG. 4.

Figure 3:
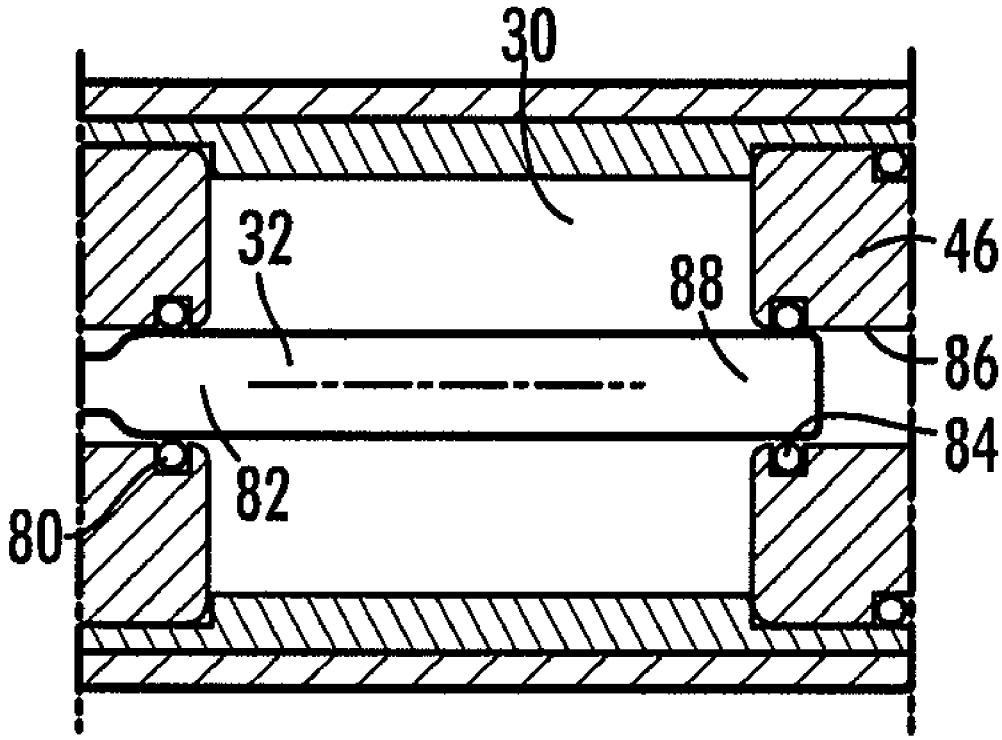
FIG. 3 is a cross-sectional view of the compressed gas storage chamber and shows the spool valve in the middle of the actuating cycle, where access of the compressed gas to the gas storage chamber is closed and gas access to the firing tube is closed as well.

FIG. 3 shows the spool valve 32 in the middle of a firing cycle, where fluid communication between the compressed gas source and the gas storage chamber 30 is prevented by the seal member 80 and cooperation of the spool valve portion 82. Access to the firing tube's 46 internal bore 86 of is still closed at this stage with the seal member 84 and forward end 88. Accordingly, a quantity of compressed gas is still held within the gas storage chamber 30.

Referring now to FIG. 4, further movement of the spool valve 32 will result in creating an opening for the compressed gas to enter the internal bore 86 of the firing tube 46 by withdrawing the forward end 88 from the seal member 84 as illustrated by discharge passageway 102. Compressed gas is then supplied to a bolt piston 104 resulting in the force to carry the bolt 54 forward by overcoming the force from the biasing member 48. At the same time, the face surface 106 of the spool valve 32 is exposed to the pressurized gas inside the gas storage chamber 30 resulting in the additional force which will help to keep the spool valve 32 in an open position until the firing cycle is finished to prevent double firing, even when gas venting from the sub chamber 90 is stopped during the firing cycle. When gas venting from the sub chamber 90 is stopped during the firing cycle, the additional force exerted from the face surface 106 compresses remaining gas inside sub chamber 90 to create enough opening to execute the firing cycle.

During firing, the force acting on the face surface 106 in the rearward direction increases as spool valve 32 is withdrawn from the firing tube 46 because the face of the spool valve 32 presents additional surface area. The resulting rearward travel of the spool valve 32 is relatively faster because the pressure in sub chamber 90 has been reduced. Accordingly, movement of the spool valve 32 is affected by reducing pressure in the sub chamber 90 in this embodiment. This results in a pneumatic tripping mechanism without additional parts, such as complicated mechanical tripping mechanisms, or expensive electronic devices. Also, this embodiment does not require manual recocking. Another advantage is the fact that the bolt 54 does not take part (participate) in any of the direct sealing means such as o-rings or other nonmetallic materials. When the bolt 54 does not execute a full loading cycle (hits the projectile during loading operation, not shown), it will reset itself quickly to the ready-to-fire position.

As the bolt 54 moves forward when the projectile 24 is first loaded into a firing position, the bolt ports 108 slide past an outer cylinder 110 of the firing tube 46 allowing compressed gas communications between the internal bore 86 of firing tube 46 and the barrel 22 through a passageway 102 to fire a projectile. The passageway 102 is used to provide gas communication to load the projectile 24 into the barrel 22 and fire the projectile 24. After compressed gas is vented from the gas storage chamber 30 to fire the projectile 24, the biasing member 48 will then return bolt 54 to the ready-to-fire position since force on the bolt piston 104 is not present.

When the trigger 16 (not shown) is released, the valve pin 36 will retract to the ready-to-fire position. This movement closes the passageway 112 with o-ring 94 and provides communication between sub chamber 90 and inlet port P through passageway 74 as seen in FIG. 1. The compressed gas present in sub chamber 90 will apply pressure on the surface area A2 of the piston 34 resulting in a force which will move spool valve 32 to the ready-to-fire position as shown in FIG. 1 by overcoming the force generated from applying pressure on the surface area A1, which is smaller than surface area A2.

Figure 5:
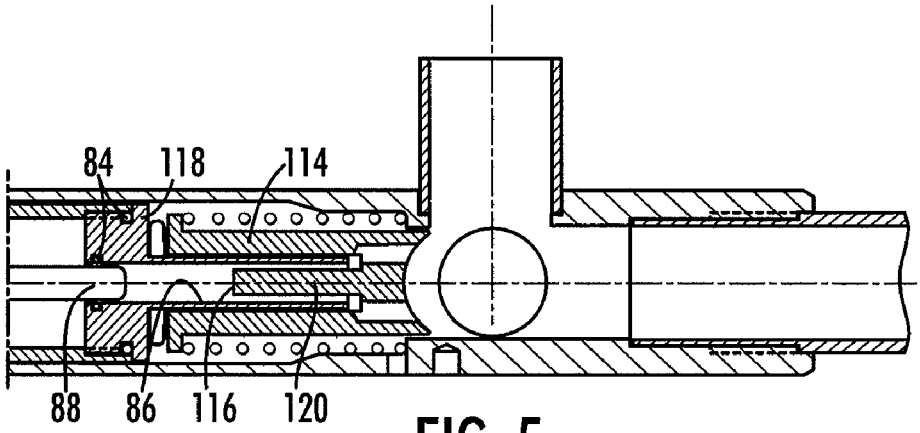
FIG. 5 is a cross-sectional view of the bolt assembly and shows an alternate embodiment of the bolt in the ready to fire position.
Figure 6:
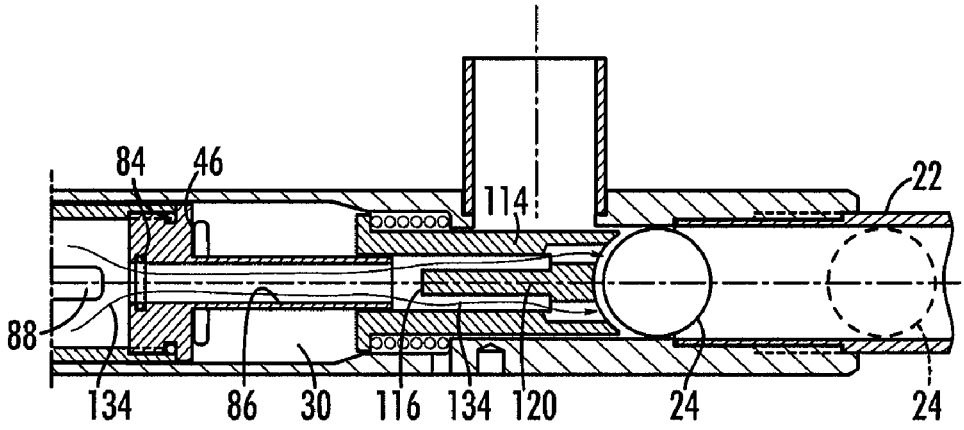
FIG. 6 is a cross-sectional view of the bolt assembly and shows an alternate embodiment of the bolt in the firing position.

Turning now to FIG. 5, an alternate embodiment of a bolt 114 is presented in the ready-to-fire position. As shown, a bolt piston 116 is extended into an annular firing tube 118 using a round shaft 120. FIG. 6 shows the marker of FIG. 5 in the firing position, where the piston 116 moves beyond the distal end of the firing tube 46, creating a passageway 134 through which compressed gas can flow to propel the projectile 24 out of the barrel 22. Loading the projectile 24 into the barrel 22 and then propelling the projectile 24 is done by gas delivery passageway 134 and powered by compressed gas from gas storage chamber 30.

Figure 5A:
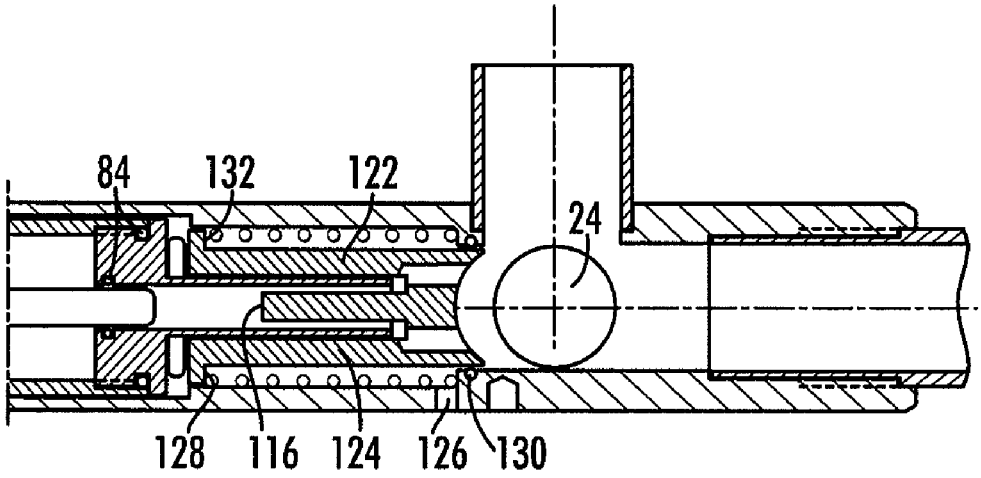
FIG. 5A is a cross-sectional view of the bolt assembly and shows an alternate way of retracting the bolt to the ready to fire position using a piston-cylinder combination instead of a spring.

FIG. 5A shows an alternate way of retracting a bolt 122 using a continuous supply of compressed gas, which enters a cylinder 124 through a passageway 126. O-rings 128 and 130 serve as seals for the piston-cylinder combination. The surface area of the piston 116 is larger than the opposing surface area 132 resulting in forward movement of the bolt 122 to first load the projectile 24 into the barrel 22 and then fire the projectile 24 as shown in FIG. 6. After the projectile 24 is fired, the absence of the compressed gas on the surface area of the piston 116 will result in returning the bolt 122 to the ready-to-fire position by the force exerted on surface area 132.

Figure 7:
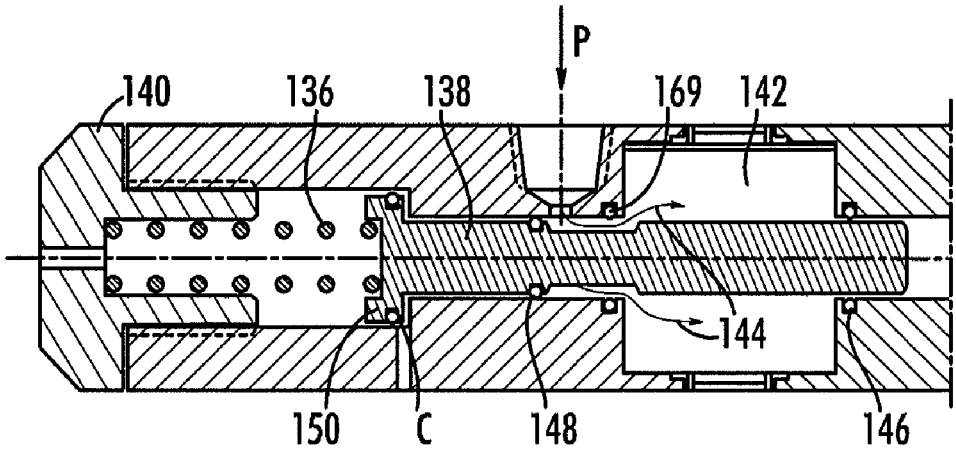
FIG. 7 is an alternate embodiment of the firing mechanism and shows a cross-section of the mechanism where the spring is used to bias the spool valve to the forward position, which corresponds to a ready to fire position.
Figure 8:
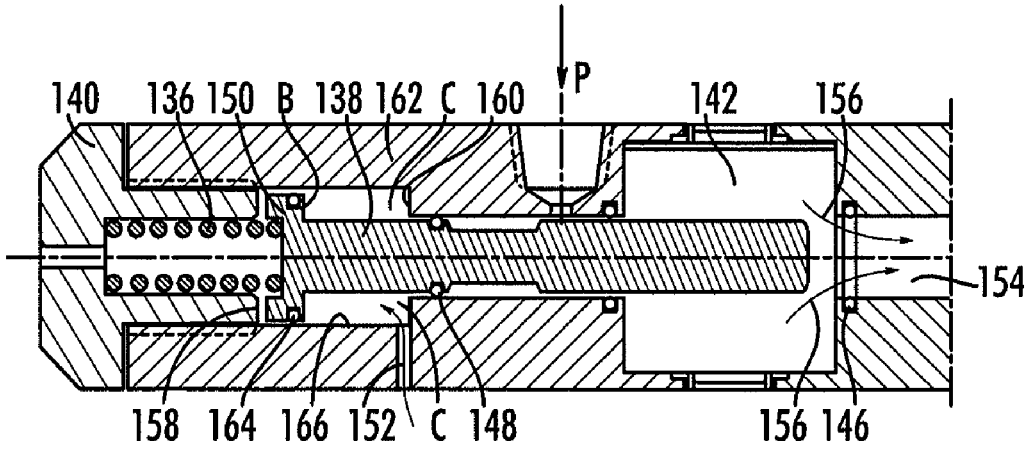
FIG. 8 is a cross-sectional view of an alternate embodiment of the firing mechanism presented in FIG. 7, but in firing position.

FIGS. 7 and 8 show an alternative embodiment of the pneumatic assembly. In this embodiment, a spring 136 is utilized to urge a spool valve 138 to a forward position, which corresponds to the ready-to-fire position. As shown, the spring 136 is disposed between an end cap 140 and a rear portion of the spool valve 138. FIG. 7 shows the firing mechanism in the ready-to-fire position with the spring 136 applying force on the spool valve 138, which results in gas communication between a gas port P and a gas storage chamber 142 through a passageway 144. Seal members 146 and 148 seal the gas storage chamber 142. An area C in front of a piston 150 is vented to the atmosphere.

When the trigger 16 (not shown in FIGS. 7 and 8) is pulled, gas communication is provided between a flow valve (not shown) and the area C of the piston 150 through a passageway 152 as shown in FIG. 8. By providing compressed gas to area C, the force exerted on the surface area B will force the spool valve 138 to a rearward position by overcoming the biasing force of the spring 136. The compressed gas disposed in the gas storage chamber 142 is then released into a firing tube 154 through a passageway 156, similar to the previous embodiment. A face surface 158 of the end cap 140 and a face surface 160 of a manifold 162 serve as a stop-bumper to limit movement of the spool valve 138 in the forward and rearward positions, which correspond to the ready-to-fire position and firing position, respectively. O-ring 164 seals the piston 150 with a cylinder 166. When the trigger 16 is released, compressed gas from area C is vented to the atmosphere, thereby moving the spool valve 138 by the force of the spring 136 back to the ready-to-fire position as seen in FIG. 7.

Figure 9:
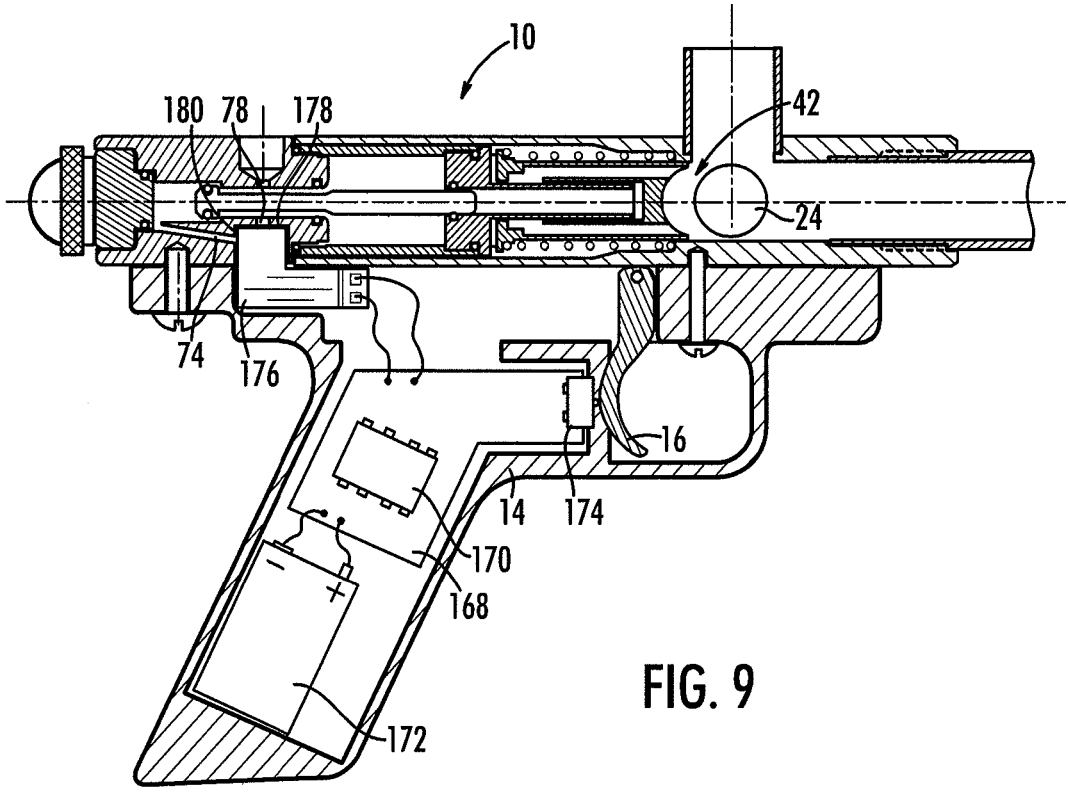
FIG. 9 is a cross-sectional view of the electrically-actuated projectile launcher.

FIG. 9 shows an embodiment in which the projectile launcher 10 is electronically controlled. In this embodiment, an electronic circuit board 168 can be mounted in the grip portion 14 and includes a processor or any other logic device 170, a source of electric power 172, and a trigger switch or sensor 174. In some cases, the sensor 174 could include a mechanical portion, such as a plunger, that comes into contact with a portion of the trigger 16 such that movement of the trigger 16 will cause movement of the mechanical portion to actuate the sensor 174. Embodiments are also contemplated in which the sensor 174 could detect the position of the trigger 16 without any direct contact. For example, the trigger 16 may include one or more magnets and the sensor 174 could be a Hall-effect sensor that could detect the position of the magnets.

An electropneumatic valve 176 may be provided to activate firing operations of the projectile launcher 10 and is connected with the circuit board 168. In such embodiments, the circuit board 168 could be configured to transmit one or more electrical pulses to operate the electropneumatic valve 176. As shown, seal members 178 and 180 provide a sealed connection with bore 78 and passageway 74 and electropneumatic valve 176.

Figure 10:
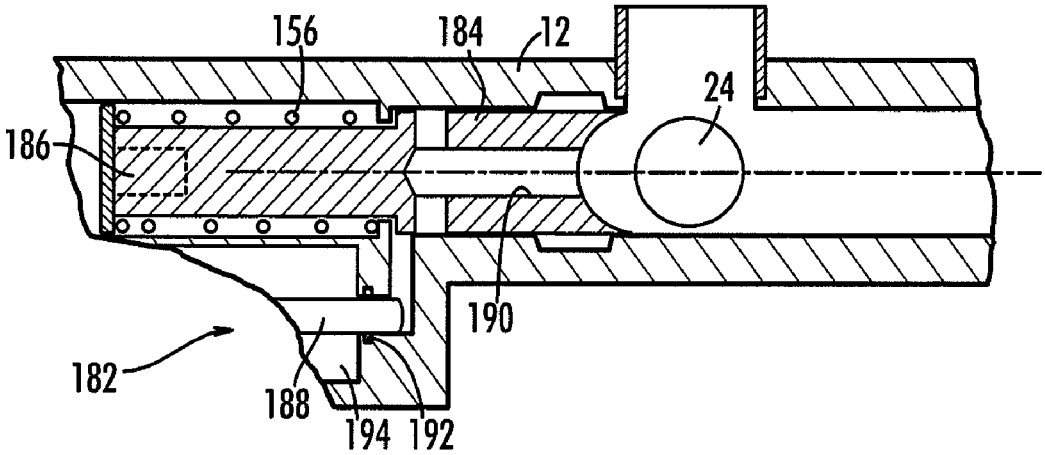
FIG. 10 is a cross-sectional view of the front portion of the launcher showing an alternate embodiment of the bolt assembly in the ready-to-fire position.

FIG. 10 illustrates an alternate embodiment of a bolt assembly 182 disposed inside the body 12. In this example, a bolt 184 is shown in the ready-to-fire position due to urging of the biasing member 156. An end cap 186 threadedly engages the bolt 184 to provide a resting surface for the biasing member 156. A spool valve 188 is shown in the ready-to-fire position where flow of compressed gas to an internal passageway 190 of the bolt 184 is prevented by a seal member 192. A gas storage chamber 194 is located in the lower portion of the body 12.

Figure 11:
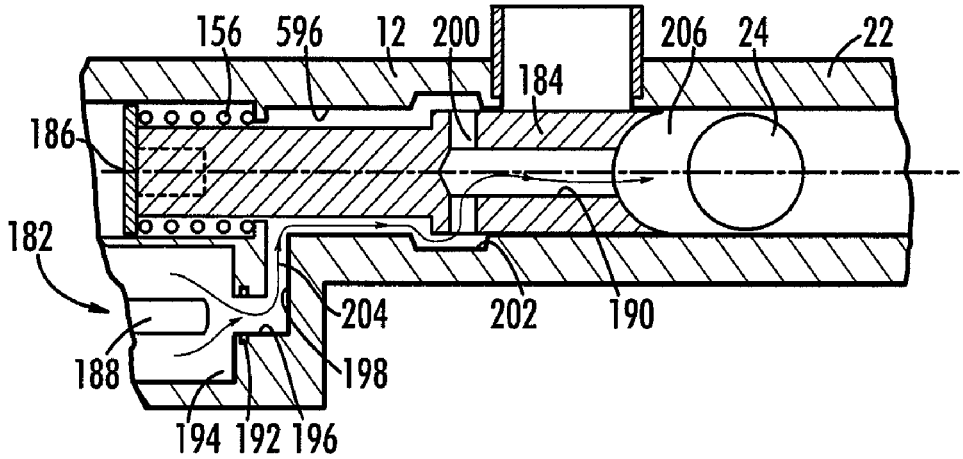
FIG. 11 is a cross-sectional view of the front portion of the launcher showing an alternate embodiment of the bolt assembly in the firing position.

FIG. 11 shows the spool valve 188 in an open position (firing position) enabling compressed gas flow through the internal passageway 190 of the bolt 184 by unsealing the seal member 192. The compressed gas in the gas storage chamber 194 flows through the bores 196, 198. This causes cross bore 200 disposed in the bolt 184 to align with a circumferential recess 202 formed inside the body 12. This allows compressed gas to enter the internal passageway 190 and propels the projectile 24 out of the barrel 22. A passageway 204 provides visual illustration of the compressed gas path from the gas storage chamber 194 to a launching chamber 206.

Figure 12:
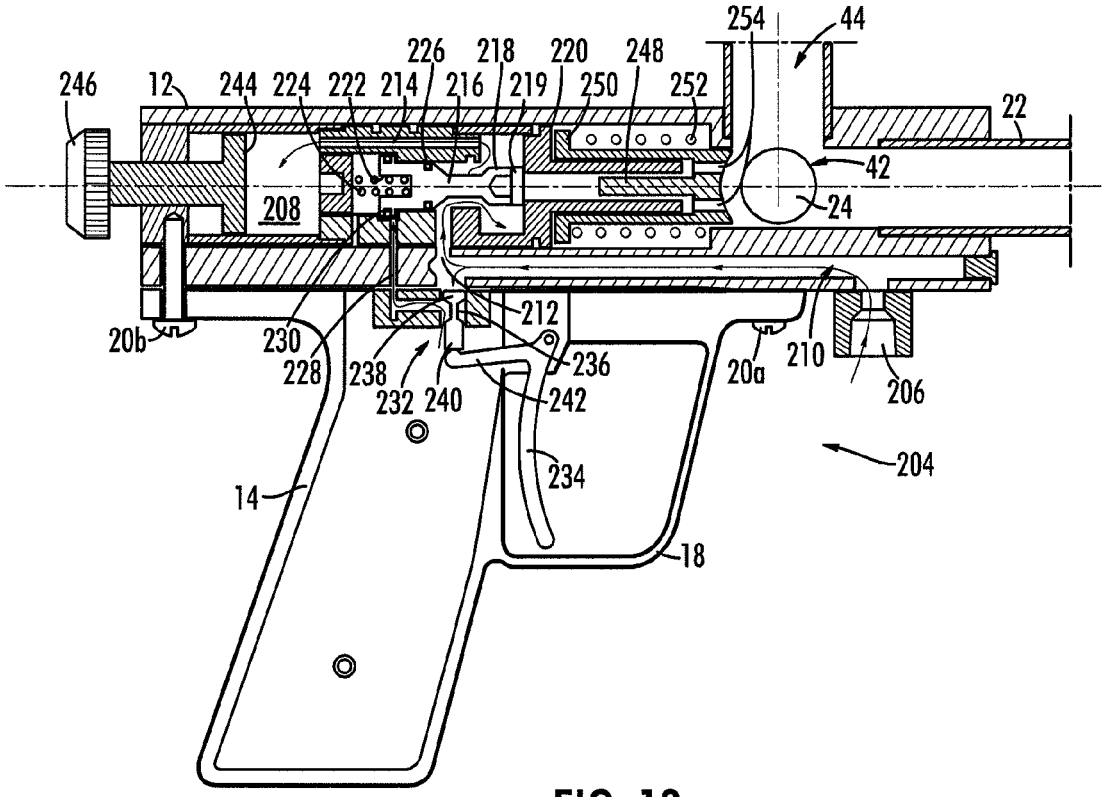
FIG. 12 is a cross-sectional view of the firing mechanism according to an alternate embodiment shown in the ready-to-fire position.
Figure 13:
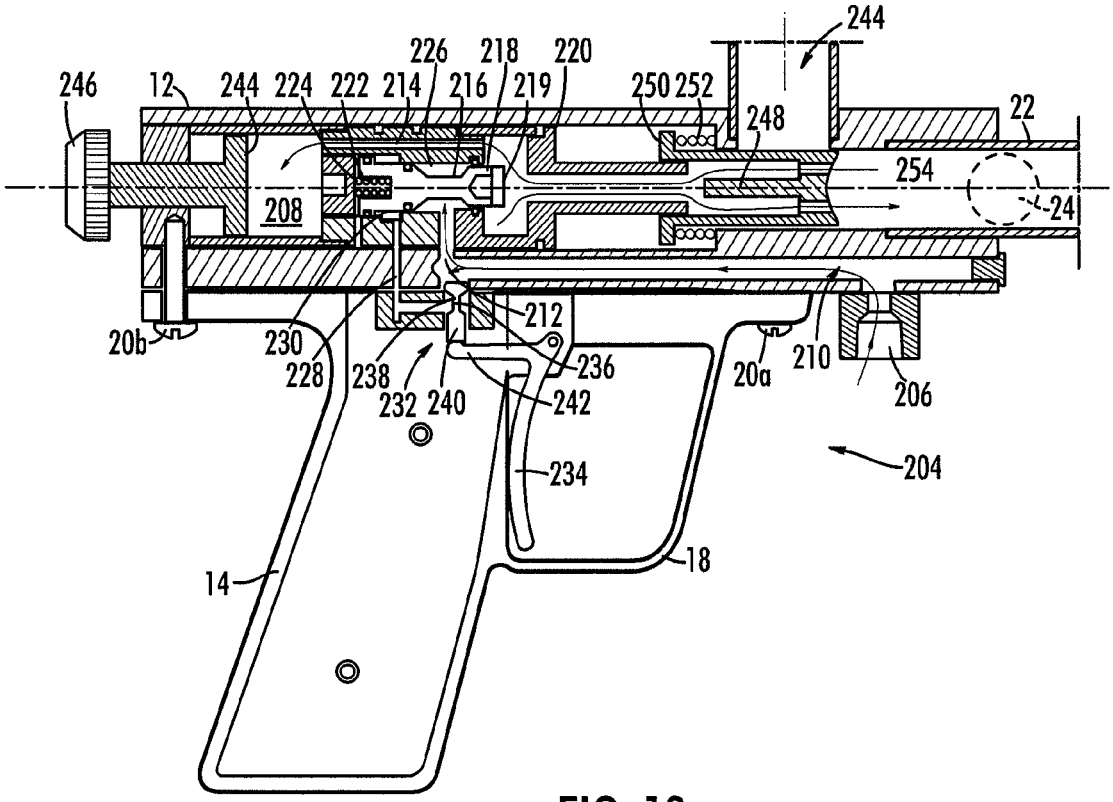
FIG. 13 is a cross-sectional view of the firing mechanism shown in FIG. 12 and showing gas flow for the firing position.

FIGS. 12 and 13 show a marker 204 according to an alternative embodiment. FIG. 12 shows the marker 204 in the ready-to-fire position, while FIG. 13 shows the marker 204 in a firing position. The marker 204 includes a gas inlet port 206 through which compressed gas enters the marker 204 from a compressed gas source (not shown). Although the gas inlet port 206 is shown on a bottom portion of the example marker 204, it should be appreciated that the gas inlet port 206 could be disposed in other positions of the marker 204.

In FIG. 12 (the ready-to-fire position), the gas inlet port 206 is in fluid communication with a gas storage chamber 208 to fill the gas storage chamber 208 with a predetermined volume of compressed gas. In the embodiment shown, an entry passageway 210 extends along a longitudinal axis of the marker 204 to a pneumatic assembly. As shown in FIG. 12, the compressed gas enters the pneumatic assembly through an entry port 212 and flows through a passageway 214 to the gas storage chamber 208.

A spool valve 216 is disposed in the pneumatic assembly in the embodiment shown. As shown, the spool valve 216 includes a sealed end 218 with a face seal 219 that prevents flow into an internal bore of a firing tube 220 when in the ready-to-fire position. In the embodiment shown, the sealed end does not extend into the firing tube 220. FIGS. 16A-18B show several embodiments in which the sealed end 218 could be implemented, as discussed below. An opposing end of the spool valve 216 includes a recessed portion 222 in which a biasing member 224 urges the spool valve 216 toward the ready-to-fire position in which the sealed end 218 prevents flow from the gas storage chamber 208 to the firing tube 220. This end of the spool valve 216 includes a seal 226, such as in o-ring, to prevent flow from the entry port 212 to a control passageway 228.

When in the firing position (FIG. 13), the control passageway 228 is used to direct compressed gas toward a flange 230 of the spool valve 216. The force of compressed gas on the flange 230 overcomes the biasing member 224 to move the spool valve 216 to the firing position, in which the gas storage chamber 208 is in fluid communication with the firing tube 220.

A control valve 232 selectively controls the flow of compressed gas into the control passageway 228, depending on the position of a trigger 234. In the embodiment shown, the control valve 232 includes a reduced dimension portion 236 between a first valve portion 238 and a second valve portion 240. The first valve portion 238 selectively allows/prevents flow from the entry passageway 210 to the control passageway 228. The second valve portion 240 selectively allows/prevents flow between the control passageway 228 and the atmosphere.

In the ready-to-fire position (FIG. 12), the first valve portion 238 blocks flow between the entry passageway 210 and the control passageway 228, while the second valve portion 240 allows the control passageway 228 to vent to the atmosphere. Accordingly, compressed gas does not act on the flange 230 of the spool valve 216.

In the firing position (FIG. 13), the control valve 232 moves (upward in the embodiment shown) so that the first valve portion 238 allows flow between the entry passageway 210 and the control passageway 228, and the second valve portion 240 prevents flow from the control passageway 228 and the atmosphere. This allows compressed gas to flow into the control passageway 228 and act on the flange 230, which overcomes the force of the biasing member 224, thereby moving the spool valve 216 to the firing position. In the embodiment shown, the trigger 234 includes a lever portion 242 that moves the control valve 232 from the ready-to-fire position to the firing position.

In the embodiment shown, a wall 244 of the gas storage chamber 208 is movable to adjust the volume of the gas storage chamber 208. As shown, an end cap 246 is coupled with the movable wall 244 so that movement of the end cap 246 allows movement of the wall 244. This allows the user to adjust the velocity at which the projectile 24 is propelled out of the barrel 22 by controlling the amount of compressed gas in the gas storage chamber 208. In some cases, for example, a paintball field or competition may limit the maximum speed at which the projectile is allowed to travel. This feature will allow the user to adjust the maximum velocity to take into account the particular conditions, such as temperature, humidity, etc. Additionally, the wall 244 allows the pressure at which the marker 204 operates to be adjusted. Typically, the marker 204 will include a pressure regulator (such as regulator 317 discussed below), which can be used to adjust the pressure at which the compressed gas enters the marker 204. To reduce breakage of weak projectiles, for example, the regulator could be adjusted to a low pressure in conjunction with moving the wall 244 to provide a larger volume within the gas storage chamber 208. In other situations, the marker 204 could be adjusted to more efficiently use compressed gas by increasing the pressure using the regulator while reducing the volume of the gas storage chamber 208 using the wall 244.

The operation of the marker 204 shown in FIGS. 12 and 13 will now be discussed. In the ready-to-fire position (FIG. 12), the biasing member 224 urges the spool valve 216 to a closed position in which the sealed end 218 prevents flow between the gas storage chamber 208 and the firing tube 220. The first valve portion 238 of the control valve 232 blocks flow between the entry passageway 210 into the control passageway 228. The compressed gas flows from a compressed gas source, through the entry passageway 210, through the pneumatic assembly (via the entry port 212 and passageway 214) and into the gas storage chamber 208. Accordingly, a predetermined volume of compressed gas fills the gas storage chamber 208. The movable wall 244 in the gas storage chamber 208 can be used to adjust the volume of compressed gas, which adjusts the projectile velocity upon firing.

When a user pulls the trigger 234, the lever portion 242 moves the control valve 232 (upward in the example shown) to a firing position. In this position, the first valve portion 238 of the control valve 232 allows flow of compressed gas into the control passageway 228, but the second valve portion 240 prevents venting of the control passageway 228 to the atmosphere. The compressed gas flowing into the control passageway 228 provides a force on the flange 230 of the spool valve 216. This compressed gas force overcomes the force of biasing member 224 and will, therefore, open the spool valve 216 (by shifting rearward in this example). When the spool valve 216 opens, the compressed gas in the gas storage chamber 208 will vent through the passageway 214 into the firing tube 220. Compressed gas is then supplied to a bolt piston 248, which moves the bolt 250 forward by overcoming the force of biasing member 252. This moves the projectile 24 to a launching position (in the barrel 22 as shown) and the compressed gas is discharged through bolt ports 254, which propels the projectile 24 out of the marker 204. Also, spool valve 248 stops more air from entering the gas storage chamber 208 when in the firing position.

When the compressed gas has vented from the gas storage chamber 208, the reduced pressure will allow the biasing member 252 to urge the bolt 250 rearward to a ready-to-fire position. The force of compressed gas acting on the other places of control valve 232 will move the control valve 232 to a ready-to-fire position when the user releases the trigger 234. This movement of the control valve 232 blocks the compressed gas from entering the control passageway 228 (via the first valve portion 238) and vents the compressed gas in the control passageway 228 to the atmosphere. Since compressed gas no longer acts on the flange 230, the biasing member 224 urges the spool valve 216 back to a closed (i.e., ready-to-fire) position. When the spool valve 216 is in the ready-to-fire position, the gas storage chamber 208 is filled with compressed gas for the next shot.

Figure 14:
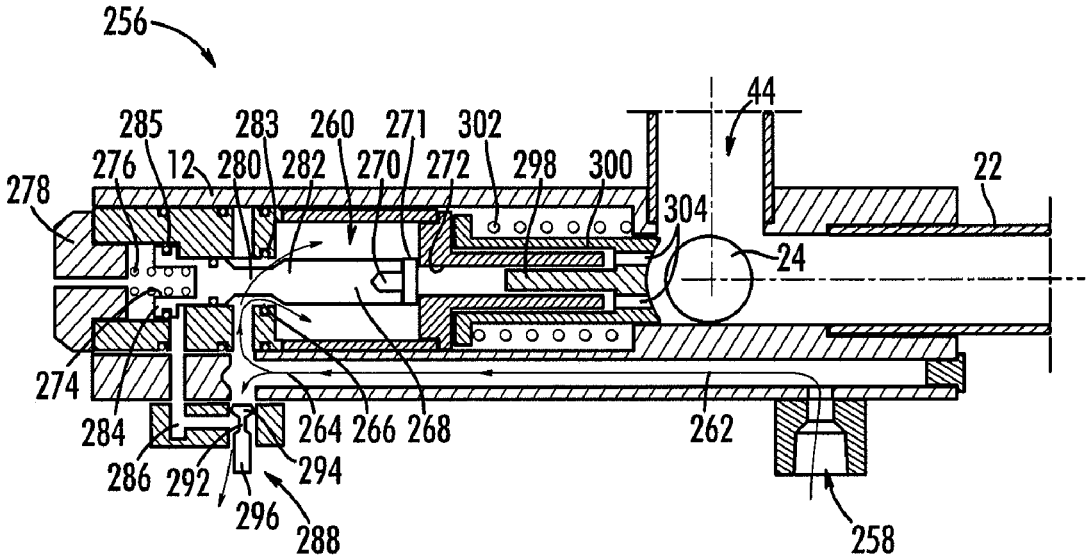
FIG. 14 is a cross-sectional view of the firing mechanism according to an alternate embodiment in ready-to-fire position.
Figure 15:
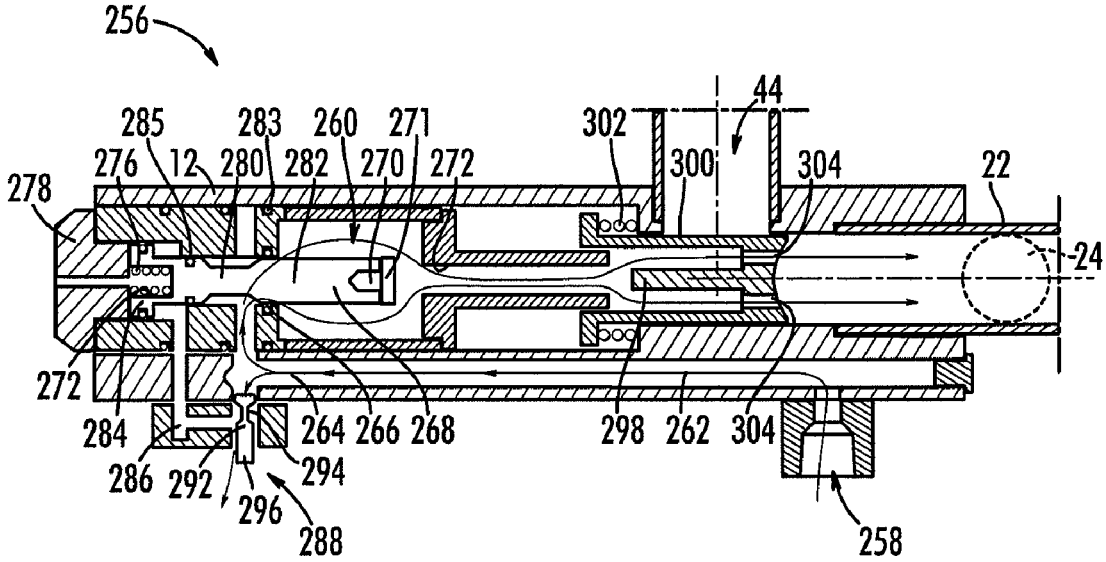
FIG. 15 is a cross-sectional view of the firing mechanism of FIG. 14 shown in a firing position.
Figure 17A:
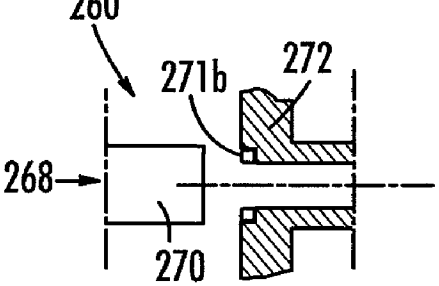

FIGS. 14 and 15 show a portion of a marker 256 according to an alternative embodiment. FIG. 14 shows the marker 256 in the ready-to-fire position, while FIG. 15 shows the marker in a firing position. The marker 256 includes a gas inlet port 258 through which compressed gas enters the marker 256 from a compressed gas source, such as a carbon dioxide canister. Although the gas inlet port 258 is shown on a bottom portion of the example marker shown, it should be appreciated that the gas inlet port 258 could be disposed on other locations of the marker 256.

The gas inlet port 258 is in fluid communication with a gas storage chamber 260 to fill the gas storage chamber 260 with a predetermined volume of compressed gas. In the embodiment shown, an entry passageway 262 extends along a longitudinal axis of the marker 256 to a firing mechanism. As shown in FIG. 14, the compressed gas enters the firing mechanism through an entry port 264 and flows through a passageway 266 to the gas storage chamber 260.

A spool valve 268 is disposed within the marker 256. As shown, the spool valve 268 includes a sealed end 270 that prevents flow between the gas storage chamber 260 and a firing tube 272, when in the ready-to-fire position. In the example shown, the sealed end 270 includes a face seal 271 that blocks flow between the gas storage chamber 260 and the firing tube 272 when in the ready-to-fire position. The opposing end of the spool valve 268 includes a recessed portion 274 in which a biasing member 276 urges the spool valve 268 toward the ready-to-fire position. In the example shown, the biasing member 276 is disposed between the spool valve 268 and in an end cap 278. The end cap 278 limits rearward movement of the spool valve 268 during the firing position. The spool valve 268 includes a reduced dimension area 280 that allows fluid communication between the entry port 264 and the passageway 266 in the ready-to-fire position. A valve portion is provided with a seal 283 to prevent flow to the gas storage chamber 260 from the entry port 264, when the marker 256 is in the firing position. The spool valve 268 includes a flange 284 with a seal 285 that is proximate to a control passageway 286.

When in the firing position (FIG. 15), the control passageway 286 is used to direct compressed gas toward the flange 284. The compressed gas force acting on the flange 284 overcomes the biasing member 276, which moves the spool valve 268 (rearward in the embodiment shown) to the firing position.

A control valve 288 selectively controls the flow of compressed gas into the control passageway 286, depending on the position of trigger (not shown). As discussed with previous embodiments, the trigger may include a lever portion that moves the control valve 288 from the ready-to-fire to the firing position. In the embodiment shown, the control valve 288 includes a reduced dimension portion 292 disposed between a first valve portion 294 and a second valve portion 296. The first valve portion 294 selectively allows/prevents flow from the entry passageway 262 to the control passageway 286. The second valve portion 296 selectively allows/prevents flow between the control passageway 286 and the atmosphere.

In the ready-to-fire position (FIG. 14), the first valve portion 294 blocks flow between the entry passageway 262 and the control passageway 286, while the second valve portion allows the control passageway 286 to vent to the atmosphere. Accordingly, no compressed gas acts on the flange 284 of the spool valve 268.

In the firing position, the control valve 288 moves (upward in the embodiment shown) so the first valve portion 294 allows flow between the entry passageway 262 and the control passageway 286 and the second valve portion 296 prevents flow from the control passageway 286 to the atmosphere. This allows compressed gas to flow into the control passageway 286 and act on the flange 284, which overcomes the force of biasing member 276 and moves the spool valve 268 to the firing position.

The operation of the marker 256 shown in FIGS. 14 and 15 will now be discussed. In the ready-to-fire position (FIG. 14), the biasing member 276 urges the spool valve 268 to a closed position in which the sealed end 270 prevents flow between the gas storage chamber 260 and the firing tube 272. The first valve portion 294 of the control valve 288 blocks flow between the entry passageway 262 and the control passageway 286. The compressed gas flows from a compressed gas source, through the entry passageway 262, through the entry port 264, passageway 266, and into the gas storage chamber 260. Accordingly, a predetermined volume of compressed gas fills the gas storage chamber 260.

When a user pulls the trigger, the control valve 288 moves to the firing position due to movement of trigger. In this position, the first valve portion 294 allows flow of compressed gas into the control passageway 286, but the second valve portion 296 prevents venting of the control passageway 286 to the atmosphere. The compressed gas flowing into the control passageway 286 provides a force on the flange 284 of the spool valve 268. This force will overcome the biasing member 276 and will, therefore, open the spool valve 268 (by shifting it rearward against the end cap 278 in this example).

With the spool valve 268 open, the valve portion 282 prevents flow from the entry passageway 262 to the gas storage chamber 260. The compressed gas in the gas storage chamber 260 vents into the firing tube 272. This compressed gas is supplied to a bolt piston 298, which moves a bolt 300 forward by overcoming the force of biasing member 302. This movement moves the projectile 24 to a launching position (in the barrel 22 as shown) and the compressed gas is discharged through the bolt ports 304. This propels the projectile 24 out of the barrel 22.

When the compressed gas has vented from the gas storage chamber 260, the reduced pressure will allow the biasing member 302 to urge the bolt 300 rearward to the ready-to-fire position. The force of compressed gas acting on the control valve 288 to a ready-to-fire position when the user releases the trigger. This movement of the control valve 288 blocks compressed gas from further entering the control passageway 286 and vents the remaining compressed gas in the control passageway 286 to the atmosphere. Since compressed gas no longer acts on the flange 284, this allows the biasing member 276 to urge the spool valve 268 back to a closed position. When the spool valve 268 is in this position, the gas storage chamber 260 is filled with compressed gas for the next shot.

Figure 16A:
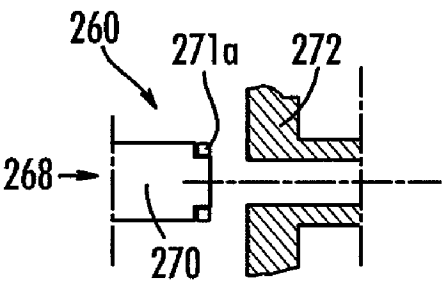
FIGS. 16 A-B, 17A-B, and 18A-B illustrate via schematic cross sectional views alternate embodiments for establishing a seal between spool element and the firing tube manifold.
Figure 18A:
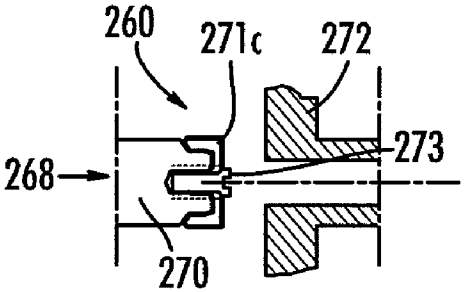
Figure 17B:
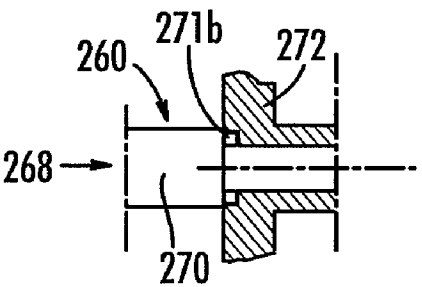
Figure 16B:
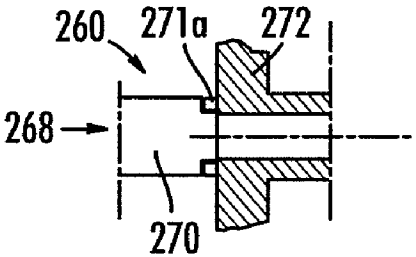
Figure 18B:
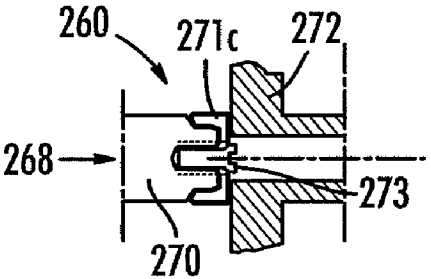

FIGS. 16A-18B show example embodiments in which venting of compressed gas within the gas storage chamber 260 may be controlled. In the embodiment shown in FIGS. 16A and 16B, the sealed end 270 of the spool valve 268 includes an O-ring 271*a* surrounding the sealed end 270 of the spool valve 268. In FIG. 16B, the ready-to-fire position, the O-ring 271*a* prevents venting of the gas storage chamber 260 into the firing tube 272. In FIG. 16A, the spool valve 268 is open which vents compressed gas into the firing tube 272. The embodiment shown in FIGS. 17A and 17B is similar to that shown in FIGS. 16A and 16B, except that the O-ring 271*b* is disposed on an end the firing tube 272. FIGS. 18A and 18B show an embodiment in which the sealed end 270 includes a face seal 271*c* that is attached to the spool valve using a fastener 273, such as a screw. In this embodiment, the face seal 271*c* prevents fluid communication between the gas storage chamber 260 and the firing tube 272 when in the ready-to-fire position (FIG. 18B) and allows venting of the gas storage chamber 260 to the firing tube 272 when in the firing position (FIG. 18A).

Figure 19:
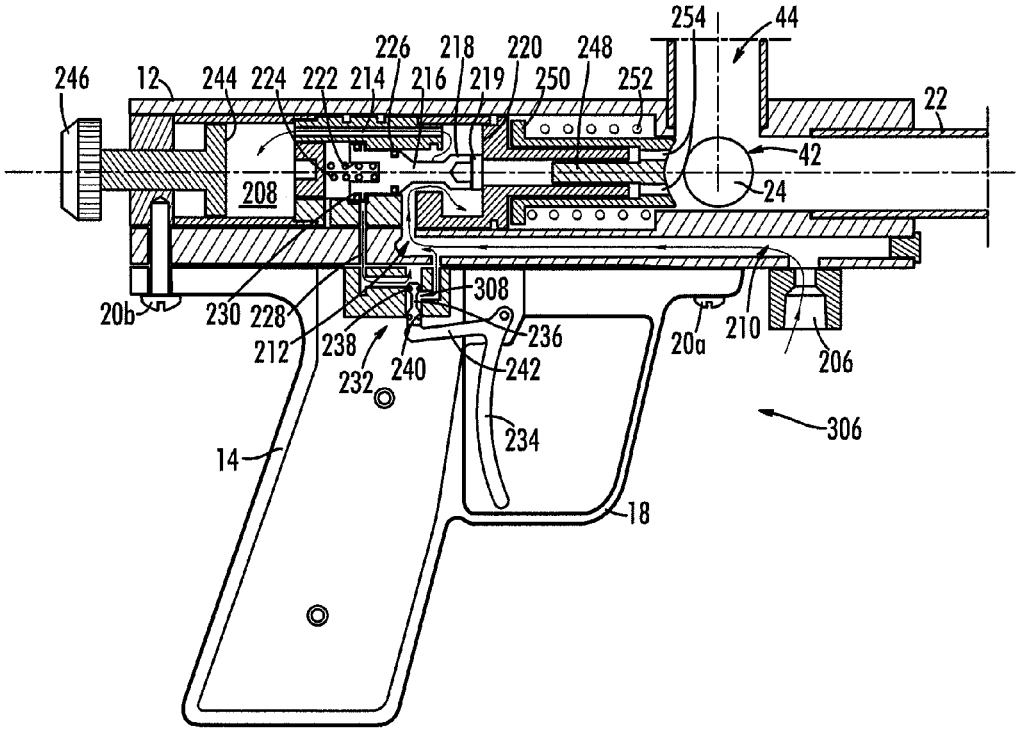
FIG. 19 is a cross-sectional view of the firing mechanism according to an alternate embodiment shown in the ready-to-fire position.
Figure 20:
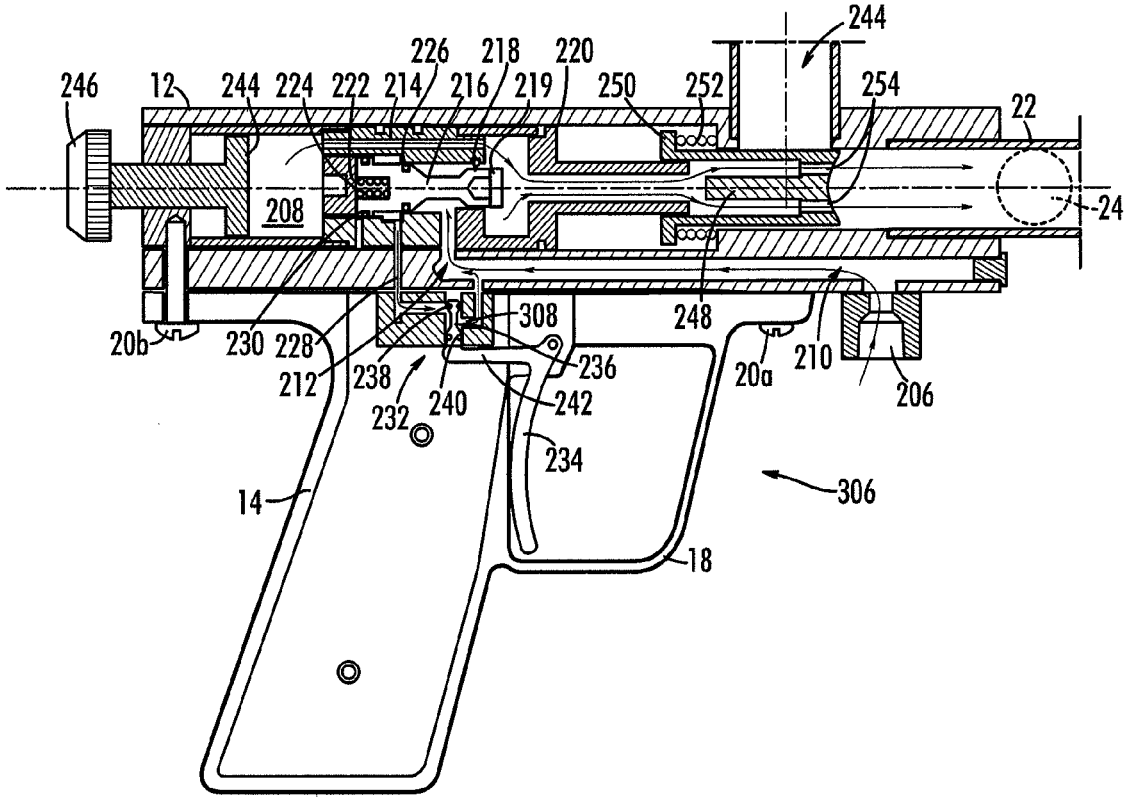
FIG. 20 is a cross-sectional view of the firing mechanism of the paintball gun of FIG. 19 shown in a firing position.

FIGS. 19 and 20 show a marker 306 according to an alternative embodiment. FIG. 19 shows the marker 306 in the ready-to-fire position, while FIG. 20 shows the marker 306 in a firing position. This embodiment is similar to the marker 204 shown in FIGS. 12 and 13, but a passageway 308 extends from the entry passageway 210 to the control valve 232. In the embodiment shown in FIGS. 19 and 20, the control valve 232 may selectively block flow between the passageway 308 and the control passageway 228. Also, the positioning of the control valve 232 blocks venting of the control passageway 228 to the atmosphere. During operation, the first valve portion 238 of the control valve prevents flow between the passageway 308 and the control passageway 228 in the ready-to-fire position and allows venting to the atmosphere. In this embodiment, a venting passageway is disposed between the grip 14 and the body 12. In the firing position (FIG. 20), the reduced dimension portion 236 of the control valve 232 allows fluid communication between the passageway 308 and the control passageway 228 and prevents venting to the atmosphere.

Figure 21:
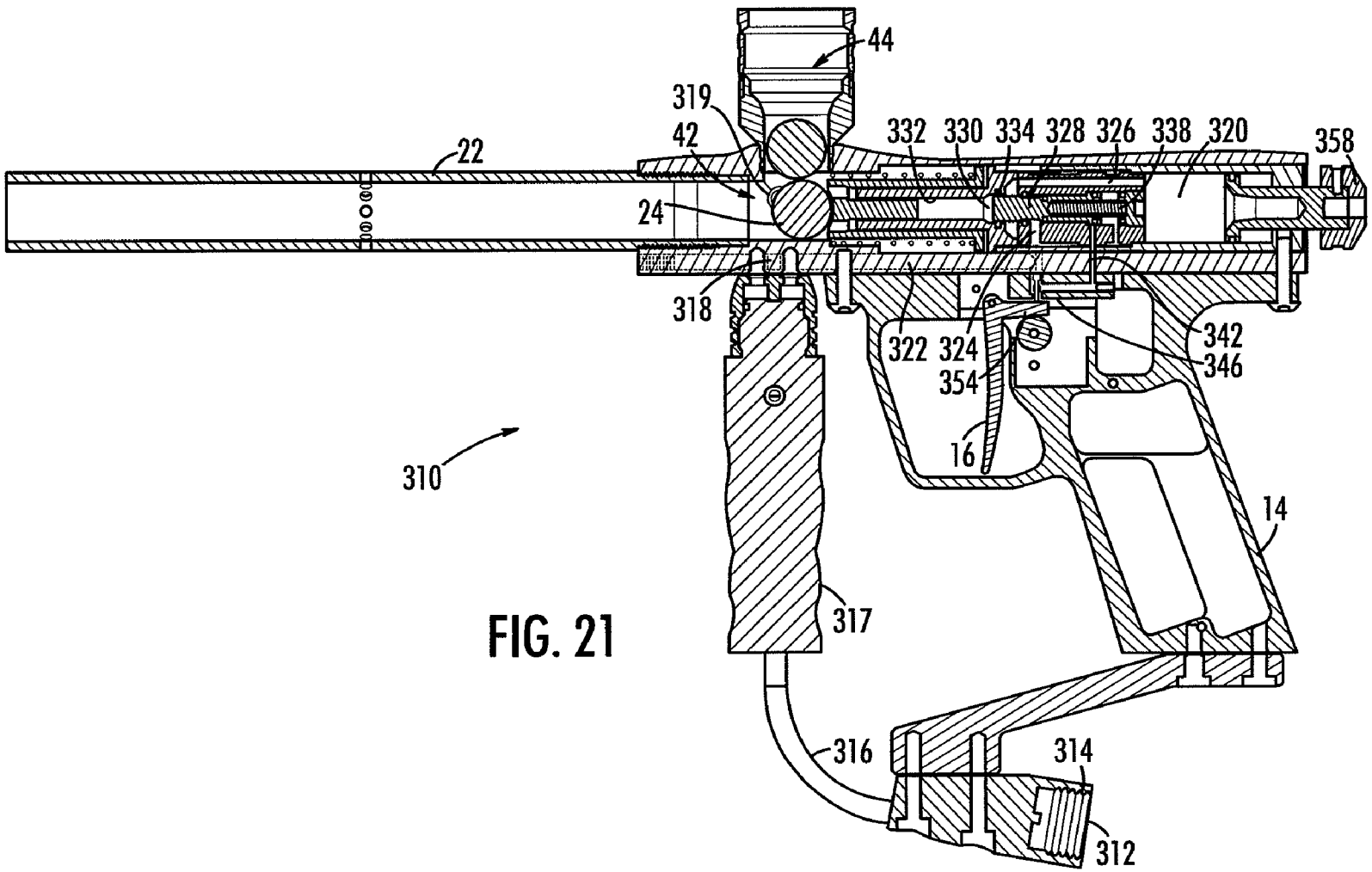
FIGS. 21 and 22 show a projectile launcher according to an alternative embodiment when in the ready-to-fire position.
Figure 22:
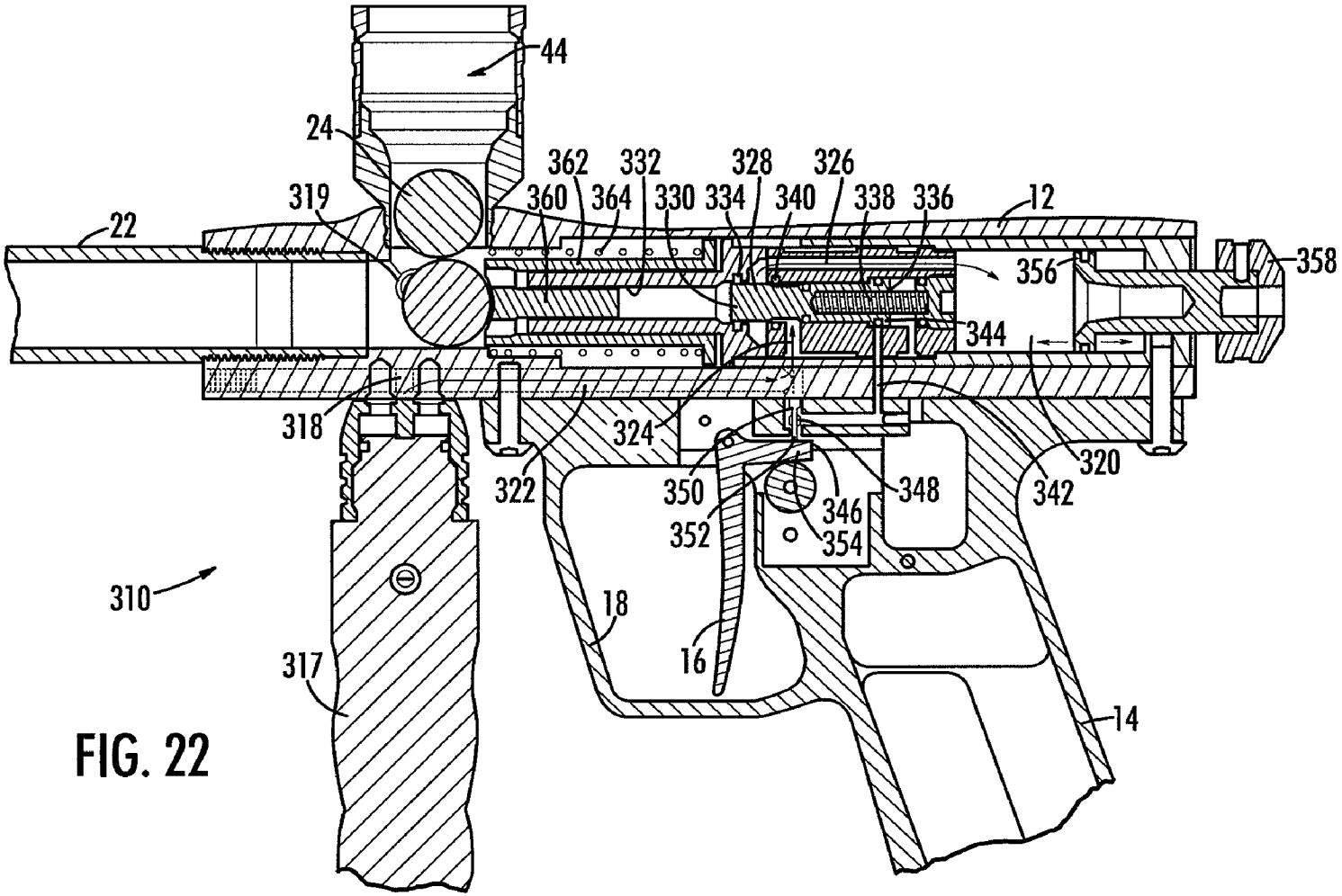
Figure 23:
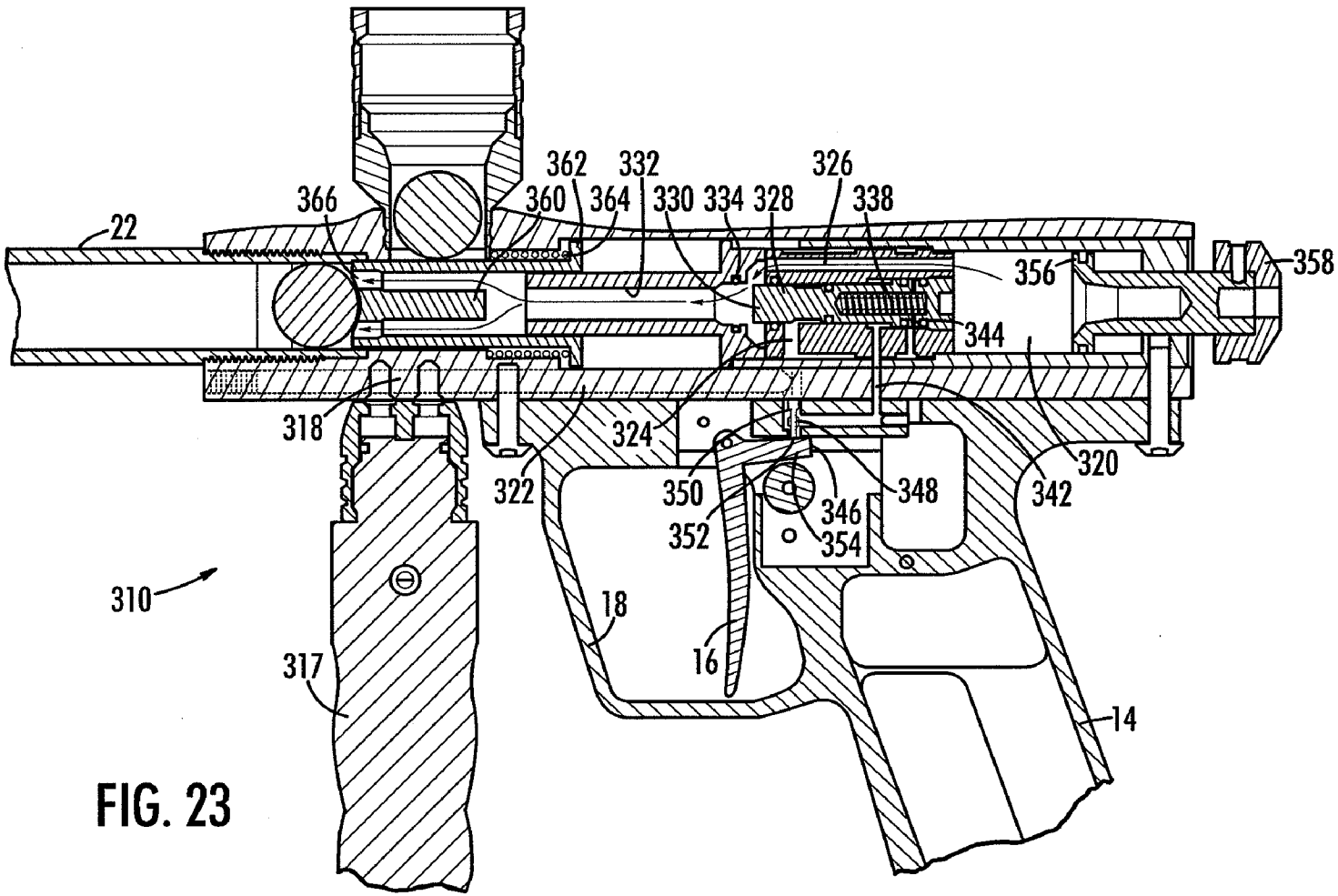
FIG. 23 shows the projectile launcher of FIGS. 21 and 22 in the firing position.

FIGS. 21-23 show a marker 310 according to an alternative embodiment. FIGS. 21 and 22 show the marker 310 in a ready-to-fire position, while FIG. 23 shows the marker 310 in a firing position. In the embodiment shown, the marker 310 includes a gas source port 312 that would be in fluid communication with a gas source (not shown).

As shown, the gas source port 312 includes internal threads 314 that could be used to mate with external threads on a compressed gas canister. It should be appreciated that other arrangements could be provided to interface a compressed gas source with the gas source port 312. In the embodiment shown, the gas source port 312 is in fluid communication with a conduit 316, which supplies the compressed gas to a regulator 317, which supplies the compressed gas to a gas inlet port 318 at a desired pressure.

In the embodiment shown, projectiles are supplied through a projectile inlet 44 via gravity force to the breech chamber 42 of the marker 310. It should be appreciated that projectiles 24 could be supplied using a force-fed feeder, such as an agitating feeder or impeller-fed feeder. As shown, the breech chamber 42 includes a spring-loaded ball detent 319 that prevents forward movement of the projectile 24 into the barrel 22 prior to firing. The biasing force of the ball detent 319 is sufficiently weak to be easily overcome when the marker 310 is fired.

The gas inlet port 318 is in fluid communication with a gas storage chamber 320 to fill the gas storage chamber 320 with a predetermined volume of compressed gas. In the embodiment shown, an entry passageway 322 extends along a longitudinal axis of the marker 310 to a pneumatic assembly. The compressed gas enters the pneumatic assembly through an entry port 324 and flows through a passageway 326 to the gas storage chamber 320.

A spool valve 328 is disposed within the firing mechanism in the embodiment shown. As shown, this spool valve 328 includes a forward end 330 that extends into a firing tube 332. A seal 334 prevents flow from the gas storage chamber 320 into the firing tube 332. As discussed above, FIGS. 16*a*-18*b* show several embodiments in which the forward end 330 could be implemented with a seal that prevents flow into the firing tube 332. FIGS. 24-31 show an embodiment in which a face seal 335 prevents flow from the gas storage chamber 320 into the firing tube 332, as discussed below. The opposing end of the spool valve 328 includes a recessed portion 336 in which a biasing member 338 is disposed. In this embodiment, the biasing member 338 urges the spool valve 328 toward the ready-to-fire position in which the forward end 330 and seal 334 prevent flow from the gas storage chamber 320 into the firing tube 332. This end of the spool valve 328 includes a seal 340 such as a O-ring, to prevent flow from the entry port 324 to a control passageway 342.

When in the firing position (FIG. 23), the control passageway 342 is used to direct compressed gas toward a flange 344 of the spool valve 328. The force of the compressed gas on the flange 344 overcomes the biasing member 338 to move the spool valve 328 to the firing position (rearward in the embodiment shown), in which the gas storage chamber 320 is in fluid communication with the firing tube 332.

In FIG. 22, control valve 346 selectively controls the flow of the compressed gas into the control passageway 342, depending on the position of the trigger. In the embodiment shown, the control valve 346 includes a reduced dimensioned portion 348 disposed between a first valve portion 350 and a second valve portion 352. The first valve portion 350 selectively allows/prevents flow from the entry passageway 322 to the control passageway 342. The second valve portion 352 selectively allows/prevents flow between the control passageway 342 and the atmosphere. In the ready-to-fire position (FIGS. 21 and 22), the first valve portion 350 blocks flow between the entry passageway 322 and the control passageway 342, while the second valve portion 352 allows the control passageway 342 to vent to the atmosphere.

Accordingly, no compressed gas acts on the flange 344 of the spool valve 328. In the firing position, the control valve 346 moves (upward in the embodiment shown) so the first valve portion 350 allows flow between the entry passageway 322 and the control passageway 342 and the second valve portion 352 prevents flow from the control passageway 342 and the atmosphere. This allows compressed gas to flow into the control passageway 342 and act on the flange 344, which overcomes the force of biasing member 338, thereby moving the spool valve 328 to the firing position. In the embodiment shown, the trigger includes a lever portion 354 that moves the control valve portion 346 from the ready-to-fire position to the firing position.

In the embodiment shown, a wall 356 of the gas storage chamber is movable to adjust the volume of the gas storage chamber 320. As shown, an end cap 358 is coupled with the wall 356 so that movement of the end cap 358 allows movement of the wall 356. This allows the user to adjust the speed at which the projectile is propelled out of the barrel by controlling the volume of compressed gas in the gas storage chamber 320. In some cases, for example, a paintball field or other competition may limit the maximum speed at which the projectile is allowed to travel. This feature would allow the user to adjust the maximum speed to take into account the particular conditions, such as temperature, humidity, etc.

Figure 34:
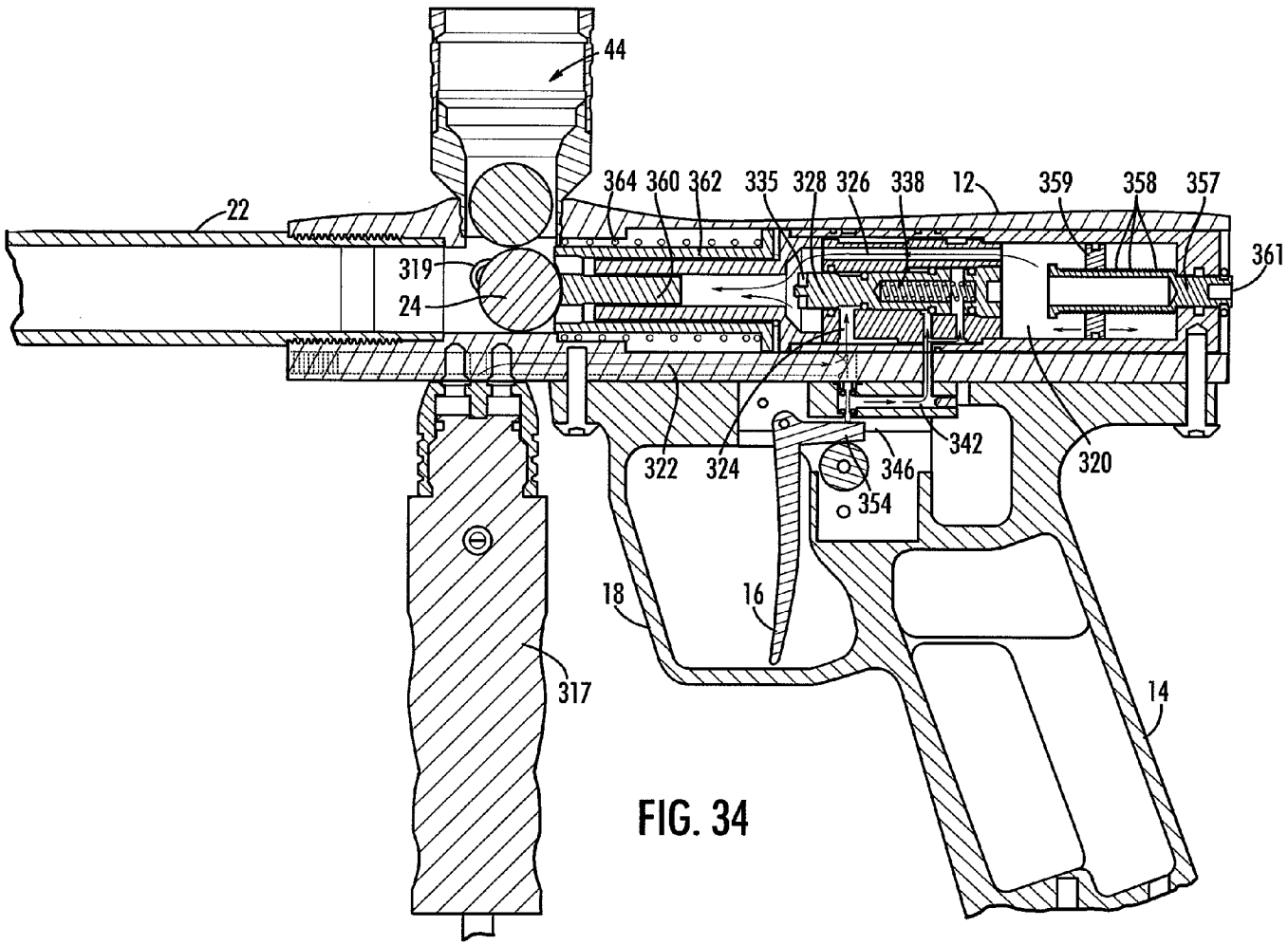
FIG. 34 shows the projectile launcher of FIG. 24 in which the volume adjustment mechanism is according to an alternative embodiment.

An alternative embodiment of projectile velocity adjustment is shown in FIG. 34. In this embodiment, an adjustment mechanism 357 with external threads 358 extends into the gas storage chamber 320. A movable wall 359 includes internal threads that mate with the external threads 358 of the adjustment mechanism 357. Accordingly, rotation of the adjustment mechanism 357, such as using a hex wrench in a recess 361, will linearly move the movable wall 359. This linear movement of the wall 359 adjusts the volume of the gas storage chamber 320, thereby adjusting the projectile velocity.

The operation of the marker 310 shown in FIGS. 21-23 will now be discussed. In the ready-to-fire position (FIGS. 21-22), the biasing member 338 urges the spool valve 328 to a closed position in which the forward end 330 and a seal 334 prevent flow between the gas storage chamber 320 and the firing tube 332. The first valve portion 350 of the control valve 346 blocks flow between the entry passageway 322 and the control passageway 342. The compressed gas flows from a compressed gas source (not shown), through the conduit 316, an adjustable gas regulator 317, gas inlet port 318, entry passageway 322, and then through the passageway 326 to the gas storage chamber 320. Accordingly, a predetermined volume of compressed gas fills the gas storage chamber 320. The movable wall 356 and the gas storage chamber 320 can be used to adjust the volume of compressed gas, which adjusts the projectile's velocity upon firing.

When the user pulls the trigger 16, the lever portion 354 of the trigger 16 moves the control valve 346 to a firing position. In this position, the first valve portion 350 of the control valve 346 allows for the compressed gas into the control passageway 342, but the second valve portion 352 prevents venting of the control passageway 342 to the atmosphere. The compressed gas flowing into the control passageway 342 provides a force on the flange 344 of the spool valve 328. This force overcomes the force of biasing member 338 and will therefore open the spool valve 328 (by shifting the spool valve 328 rearward in this example). When the spool valve 328 opens, the compressed gas in the gas storage chamber 320 will vent through the passageway 326 into the firing tube 332. The compressed gas is then supplied to a bolt piston 360, which moves the bolt 362 forward by overcoming the force of biasing member 364. This moves the projectile to a launching position (in barrel as shown in FIG. 23) and the compressed gas is discharged through the bolt ports 366, which propels the projectile out of the marker 310.

When the compressed gas has vented from the gas storage chamber 320, the reduced pressure will allow biasing member 364 to move the bolt 362 rearward to the ready-to-fire position. The force of compressed gas acting on the control valve 346 will move the control valve 346 to the ready-to-fire position when the user releases the trigger. This movement blocks compressed gas from entering the control passageway 342 (due to the first valve portion 350) and vents the compressed gas remaining in the control passageway 342 to the atmosphere. Since the compressed gas no longer acts on the flange 344, this allows the biasing member 338 to urge the spool valve 328 back to a closed (i.e., ready-to-fire) position. When the spool valve 328 is in this position, the gas storage chamber 320 is filled with compressed gas for the next shot.

Figure 24:
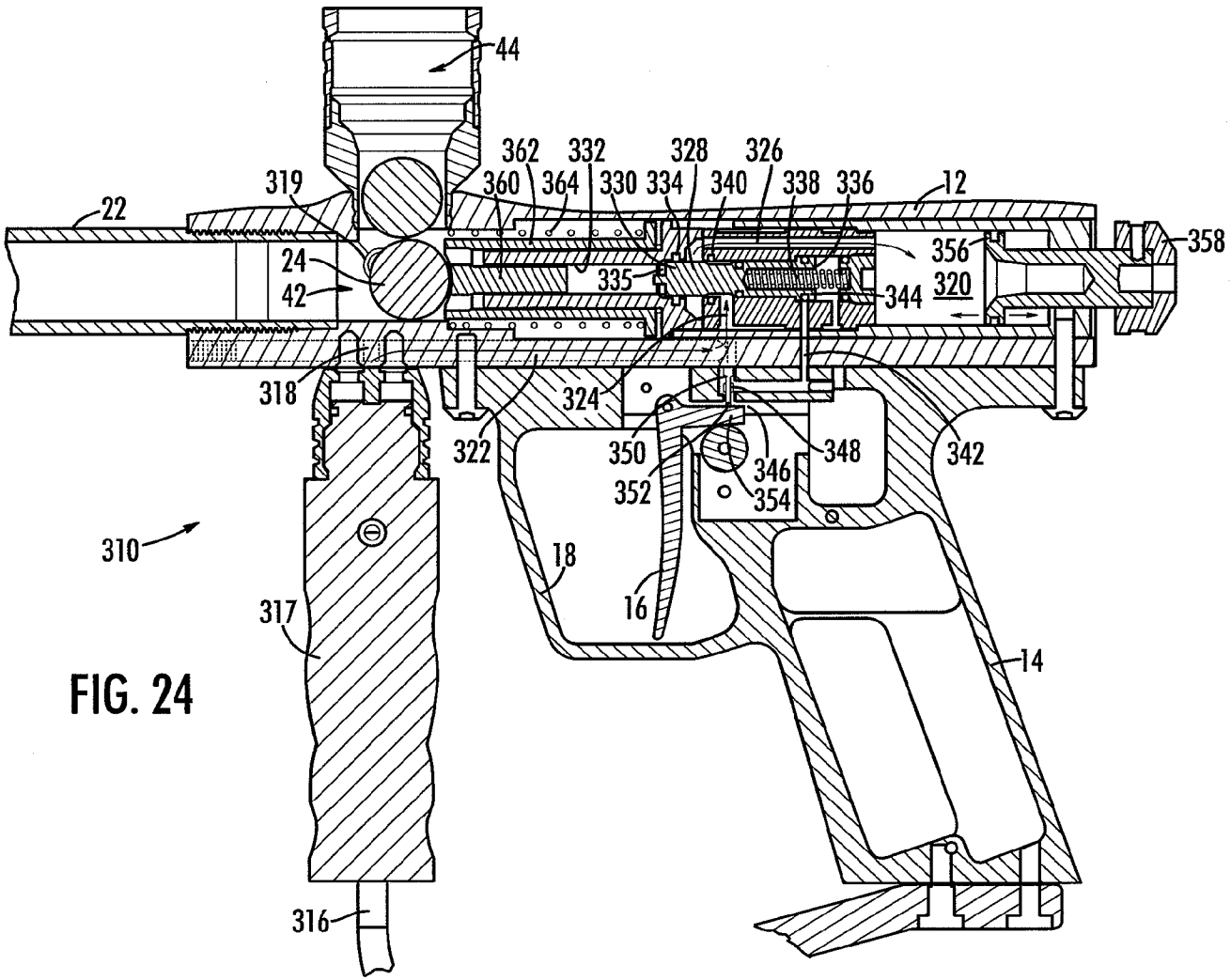
FIGS. 24-31 show the firing sequence of the projectile launcher of FIG. 21 using a face seal on the spool valve.

The operation of the marker 310 shown in FIGS. 24-31 in which a face seal 335 blocks flow between the gas storage chamber 320 and the firing tube 332 when in the ready-to-fire position will now be discussed. FIG. 24 shows the marker 310 in the ready-to-fire position, in which compressed gas flows into the gas storage chamber 320 via the entry passageway 322, entry port 324, and passageway 326. This fills the gas storage chamber 320 with a predetermined volume of compressed gas.

Figure 25:
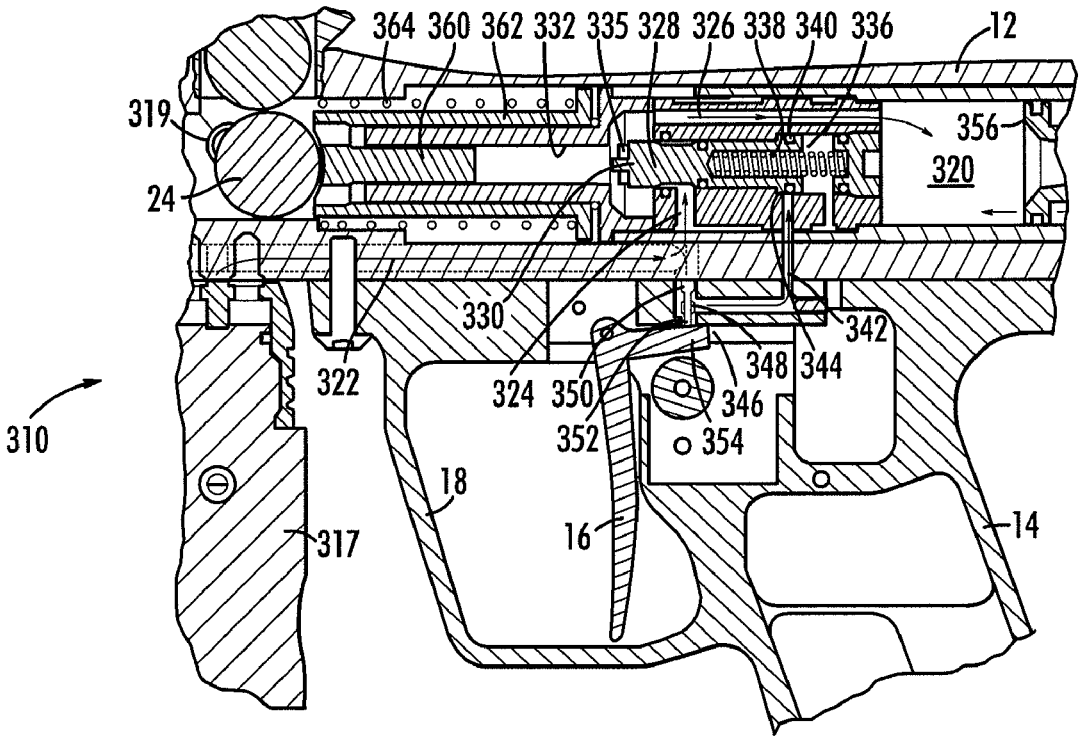
Figure 26:
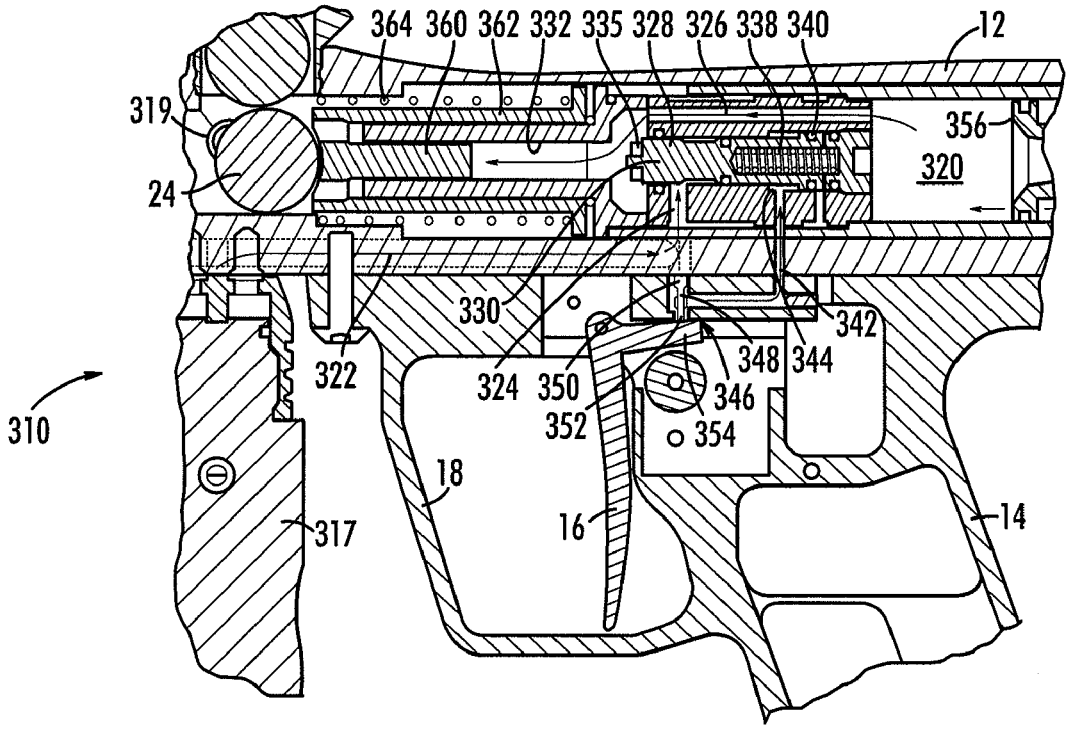

FIG. 25 shows the marker 310 initially after the user has pulled the trigger 16, which moves the control valve 346 to an open position. In this position, the first valve portion 350 of the control valve 346 allows compressed gas to flow from the entry passageway 322 into the control passageway 342. This allows compressed gas to act on the flange 344 of the spool valve 328. As shown in FIG. 26, the compressed gas force on the flange 344 overcomes the biasing force of the biasing member 338 to move the spool valve 328 rearward, which unseals the firing tube 332. This allows the compressed gas in the gas storage chamber 320 to vent into the firing tube 332.

Figure 27:
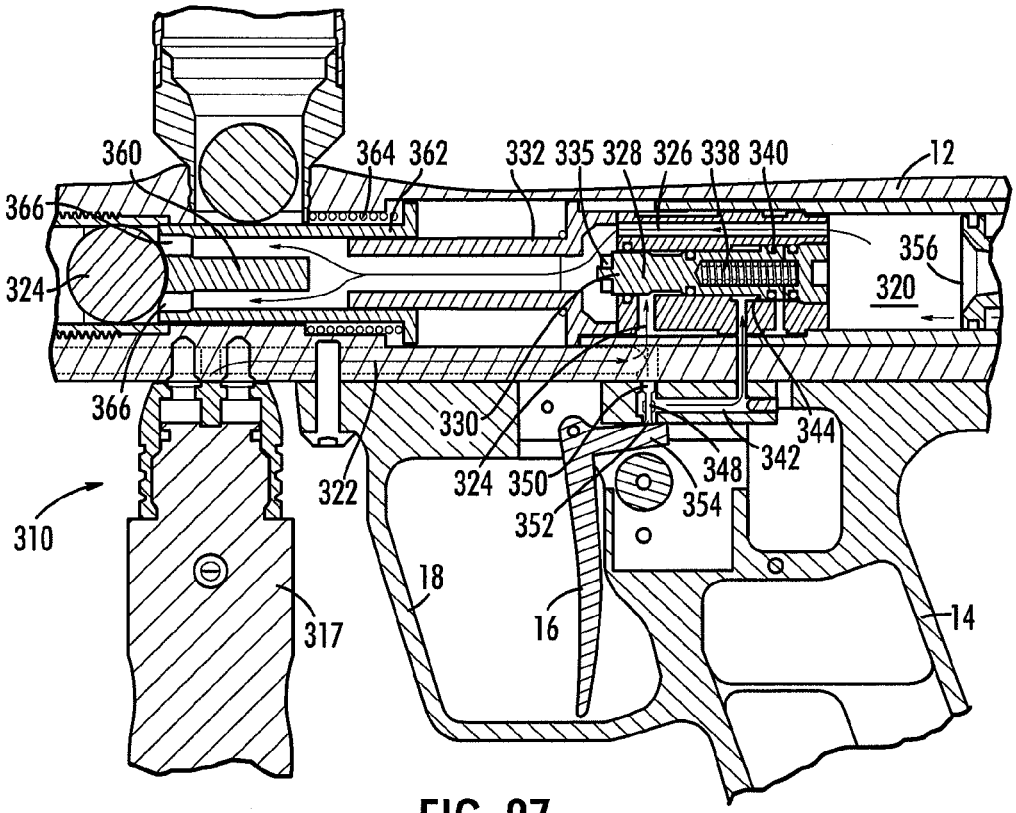
Figure 28:
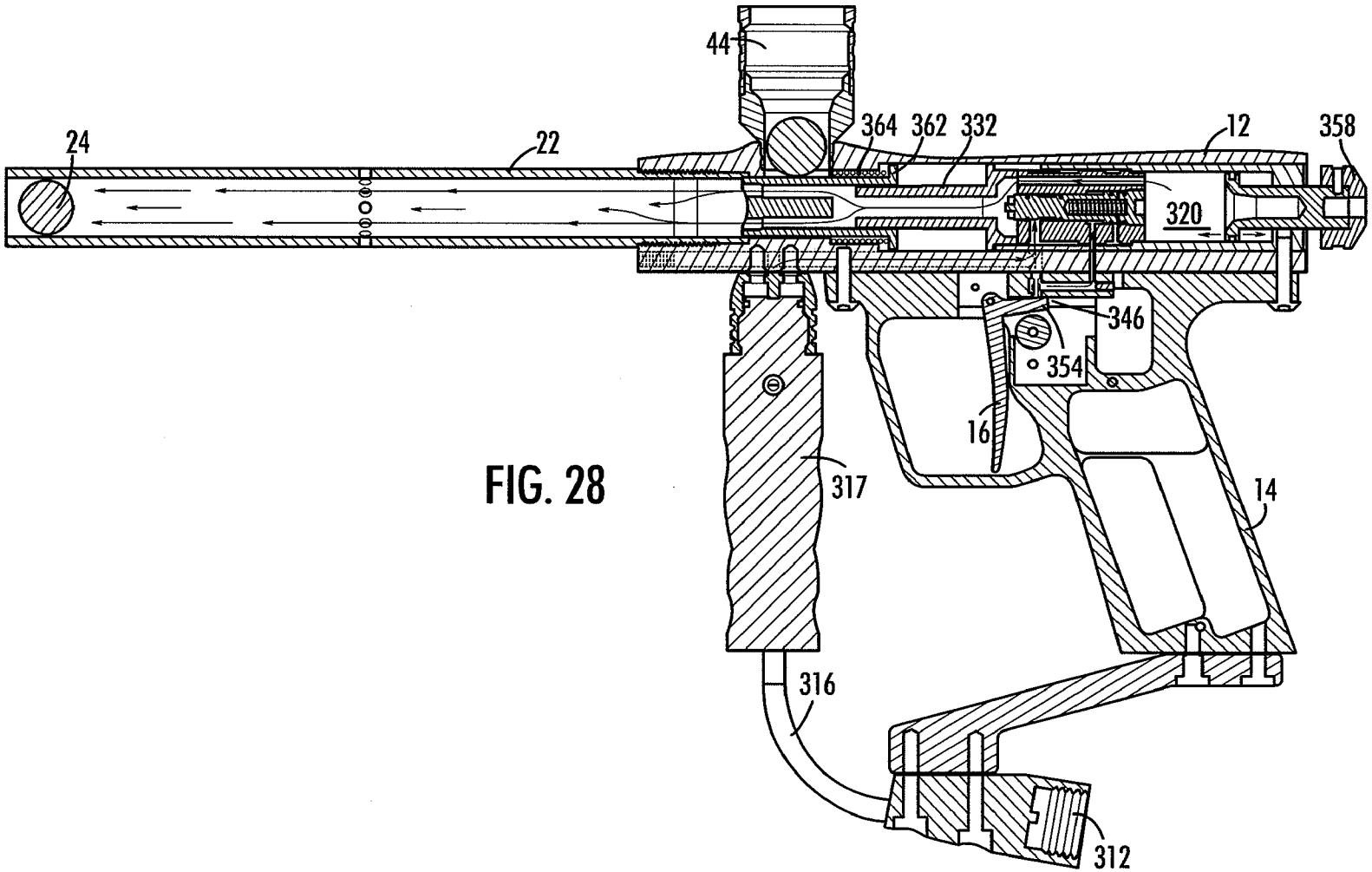

FIG. 27 shows the spool valve 328 open with compressed gas in the gas storage chamber 320 venting into the firing tube 332. The compressed gas is then supplied to a bolt piston 360, which moves the bolt 362 forward by overcoming the force of biasing member 364. This moves the projectile to a launching position (in barrel 22 as shown) and the compressed gas is discharged through the bolt ports 366, which propels the projectile out of the marker 310, as shown in FIG. 28.

Figure 29:
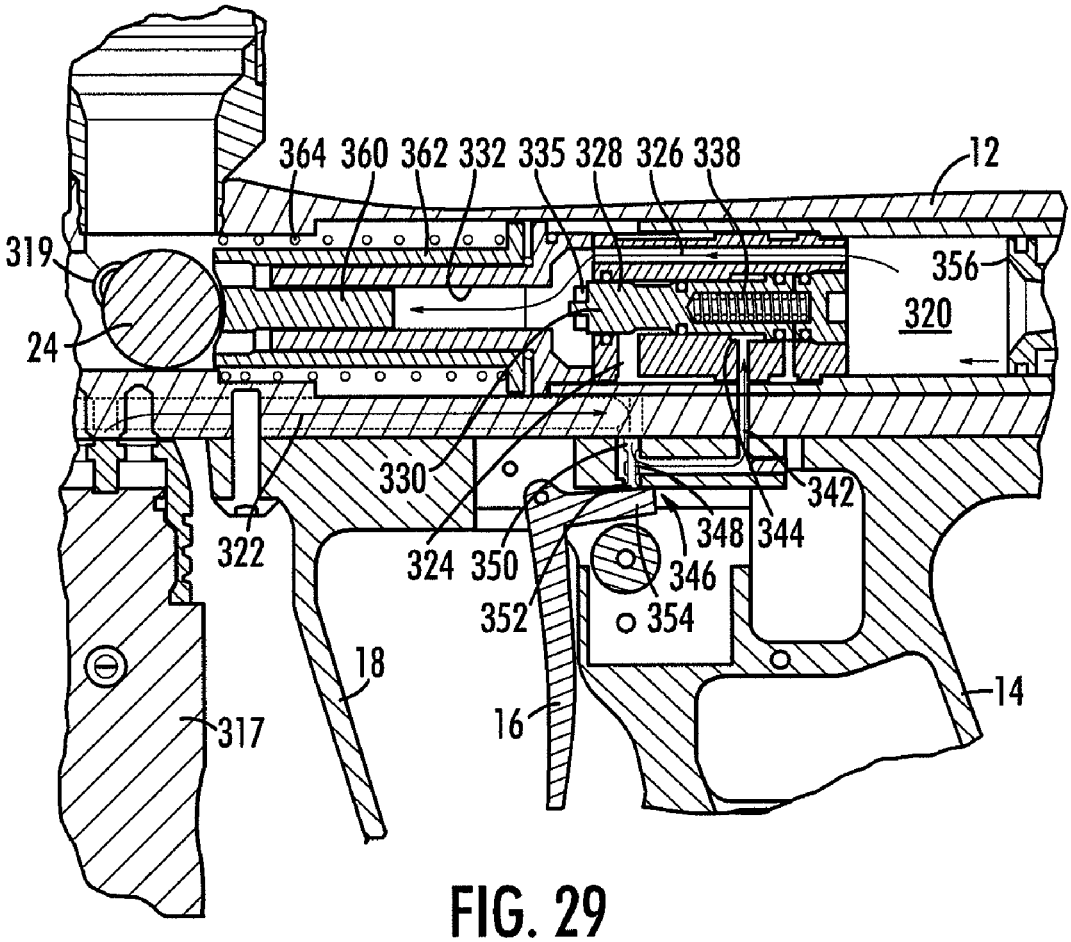
Figure 30:
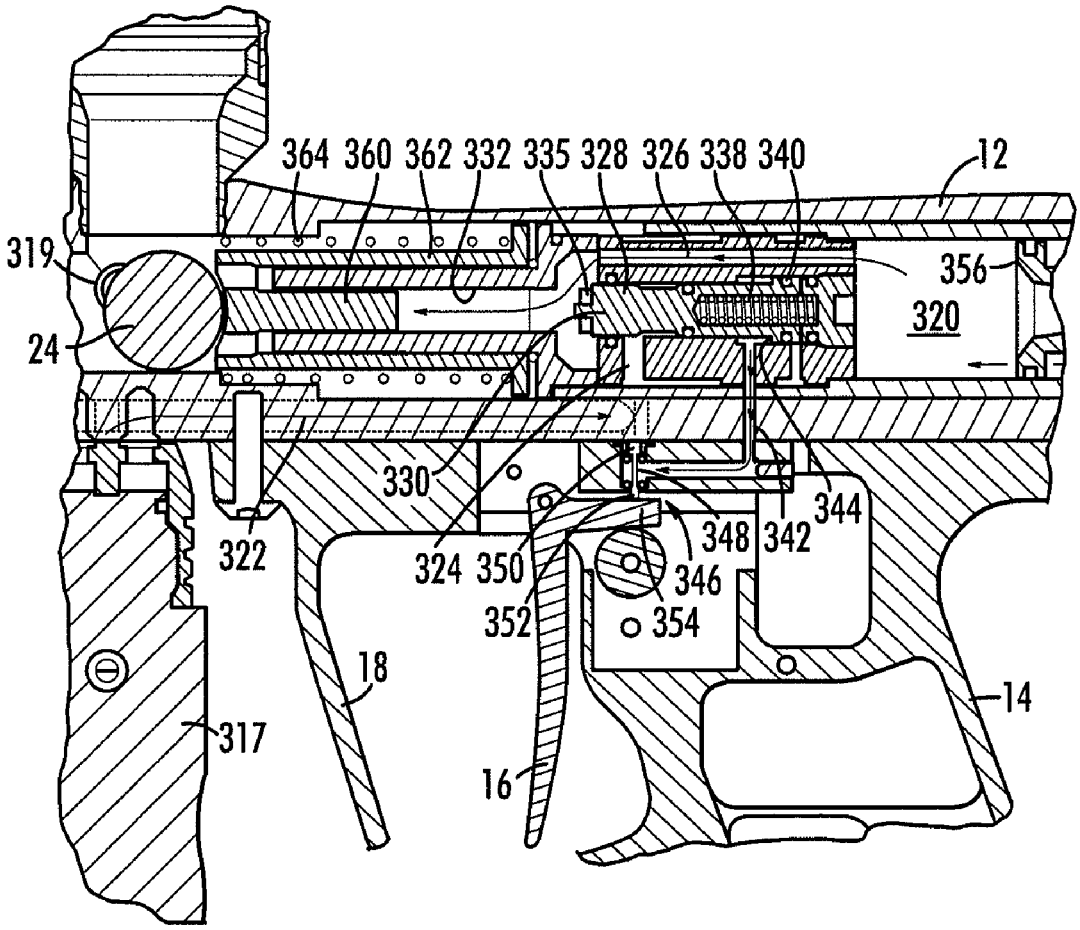
Figure 31:
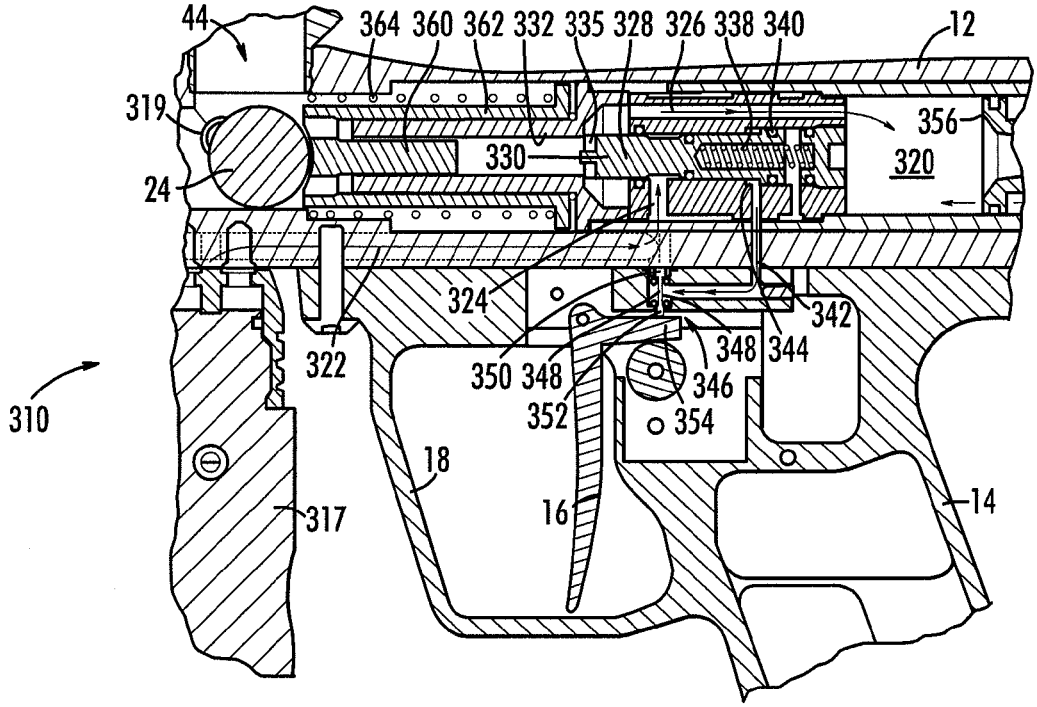

When the compressed gas has vented from the gas storage chamber 320, the reduced pressure will allow biasing member 364 to move the bolt 362 rearward to the ready-to-fire position, which allows the next projectile to enter the breech chamber 46 as shown in FIG. 29. The force of compressed gas acting on the control valve portion 346 will move the control valve 346 to the ready-to-fire position when the user releases the trigger, as shown in FIG. 30. This movement blocks compressed gas from entering the control passageway 342 (due to the first valve portion 350) and vents the compressed gas remaining in the control passageway 342 to the atmosphere. Since the compressed gas no longer acts on the flange 344, this allows the biasing member 338 to urge the spool valve 328 back to a closed (i.e., ready-to-fire) position, as shown in FIG. 31. When the spool valve 328 is in this position, the gas storage chamber 320 is filled with compressed gas for the next shot.

Figure 32:
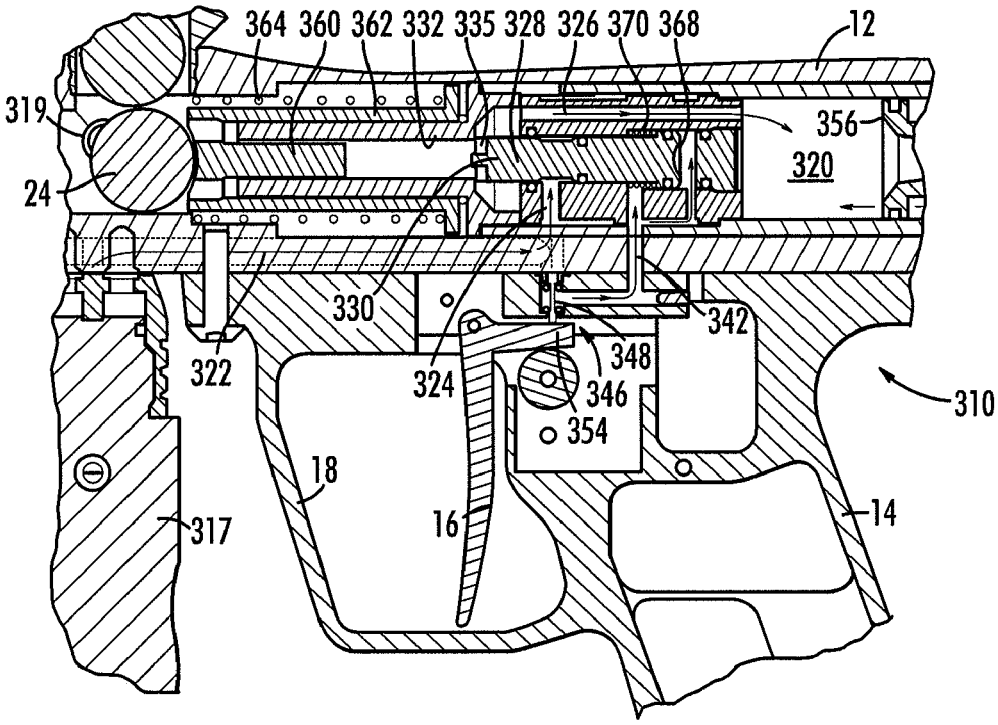
FIG. 32 shows a projectile launcher according to an alternative embodiment when in the ready-to-fire position.
Figure 33:
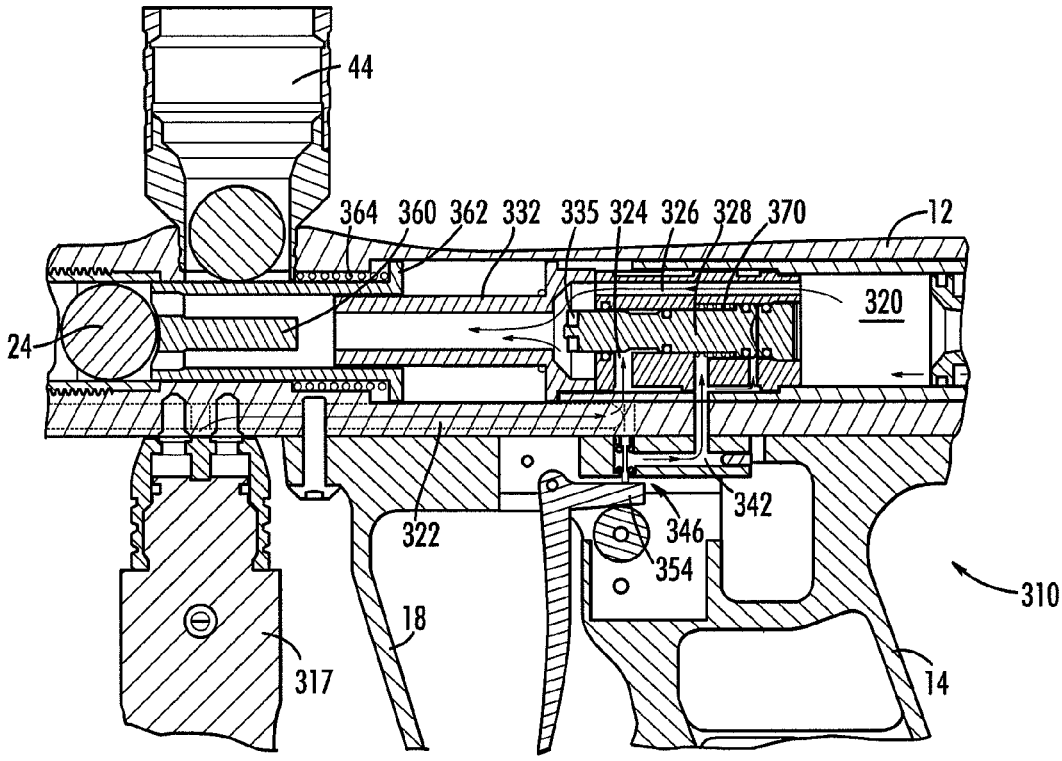
FIG. 33 shows a projectile launcher of FIG. 32 in the firing position.

FIGS. 32 and 33 show an alternative embodiment in which the spool valve is urged closed (i.e., to the ready-to-fire position) using compressed gas. FIG. 32 shows the marker 310 in the ready-to-fire position while FIG. 33 shows the marker 310 in the firing position. In this embodiment, the control valve 346 allows flow into the control passageway 342 when in the ready-to-fire position. The compressed gas acts on a surface 368 of the spool valve 328, which overcomes a biasing force of a biasing member 370 to maintain the spool valve 328 in the closed position. When a user pulls the trigger 16, the control valve 346 prevents flow from the entry passageway 322 into the control passageway 342. Also, the control valve 346 vents the compressed gas in the control passageway 342 to the atmosphere. This relieves the surface 368 of compressed gas force, which allows the biasing force of the biasing member 370 to urge the spool valve 328 to an open position. This vents the gas storage chamber 320, as discussed above.

Figure 35:
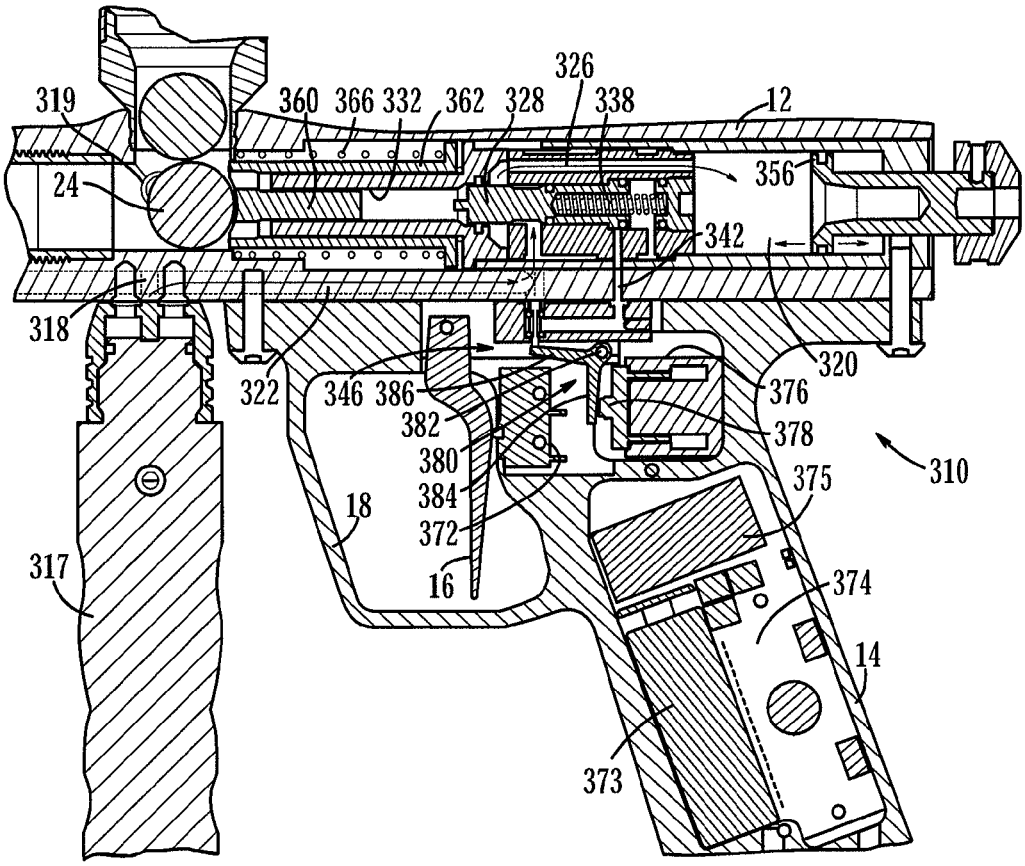
FIG. 35 shows a projectile launcher according to an alternative embodiment when in the ready-to-fire position.
Figure 36:
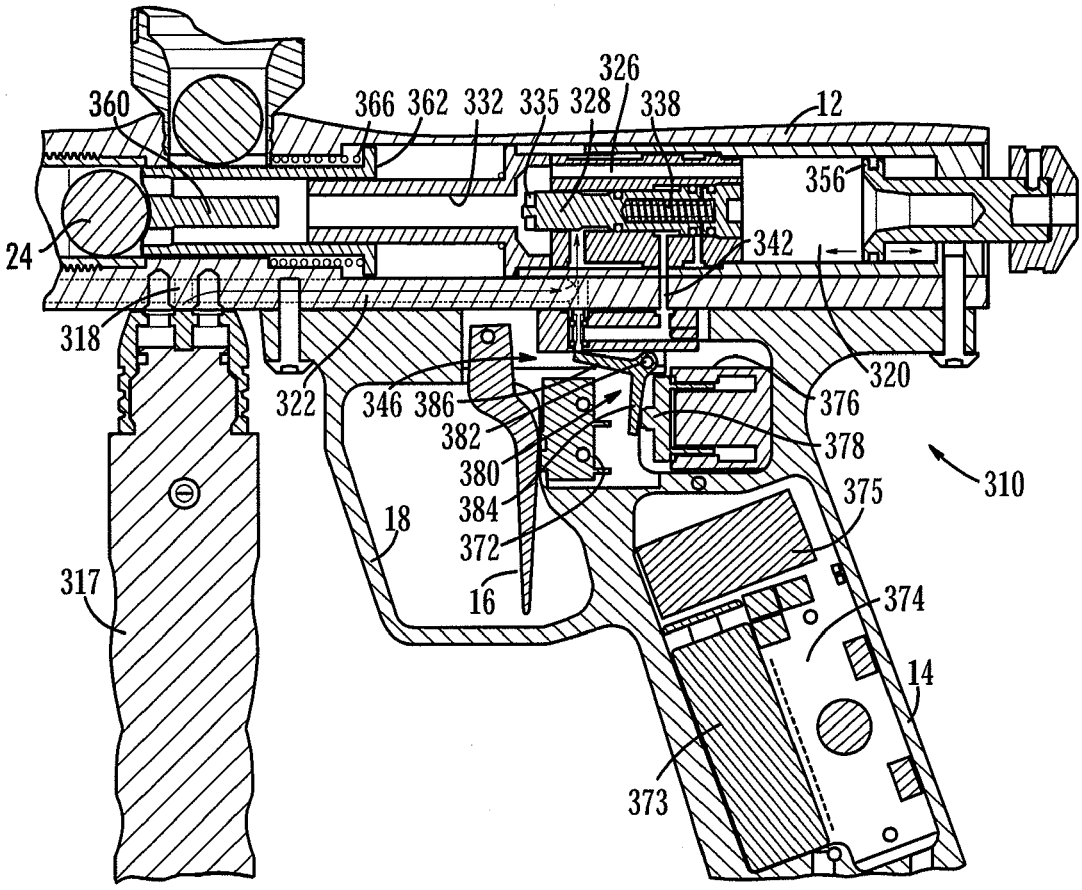
FIG. 36 shows the projectile launcher of FIG. 35 when in the firing position.

FIGS. 35 and 36 show an alternative embodiment in which the pneumatic assembly is electronically controlled. FIG. 35 shows the marker 310 in the ready-to-fire position while FIG. 36 shows the marker 310 in the firing position. In the embodiment shown, the trigger 16 actuates a switch or sensor 372, which is electronically connected with a controller circuit 374. Although the sensor 372 is a contact switch in the embodiment shown, the sensor 372 could detect movement of the trigger 16 in another manner. For example, an embodiment is contemplated in which the sensor 372 is a Hall-effect sensor that detects movement of magnets associated with the trigger. Such an arrangement is described in co-pending application Ser. No. 60/942,144, filed Jun. 5, 2008, which is hereby incorporated by reference. A power source 373, such as a battery, and a capacitor 375 (and/or other electronic components) may be associated with the controller circuit 374 in some embodiments. In the embodiment shown, the controller circuit 374 and other electronic components 373, 375 are disposed within the grip 14; however, one or more of these components could be located in other areas of the marker 310.

When the user pulls the trigger 16, the controller circuit 374 actuates a linear actuator 376 responsive to the sensor 372. The linear actuator 376 includes a movable portion 378 that is movable between a first position (FIG. 35) and a second position (FIG. 36). For example, embodiments are contemplated in which the linear actuator 376 could be a voice coil or like device. It should be appreciated that other electronically-actuated linear actuators may also be suitable.

A sear-like member or lever 380 pivots about a pin 382. This lever 380 is somewhat analogous to a sear that initiates a firing sequence in a projectile launcher, such as that described in U.S. Published Patent Application 2006/0169268, which is hereby incorporated by reference. As shown, the lever 380 includes a first arm 384 adjacent the end of the moveable portion 378 of the linear actuator 376 and a second arm 386 adjacent the control valve 346. With this arrangement, movement of the moveable portion 378 from the first position to the second position pivots the lever 380 to actuate the control valve 346. This initiates the firing sequence as described above.

FIGS. 37-45A discuss another embodiment in which a marker includes a feature that reduces breakage and/or shearing of projectiles during firing. This feature could be implemented with the pneumatic assembly discussed above, or with other valve arrangement for venting compressed gas to propel a projectile. Moreover, this embodiment could be adapted for use with combustion-power projectile launchers.

Figure 37:
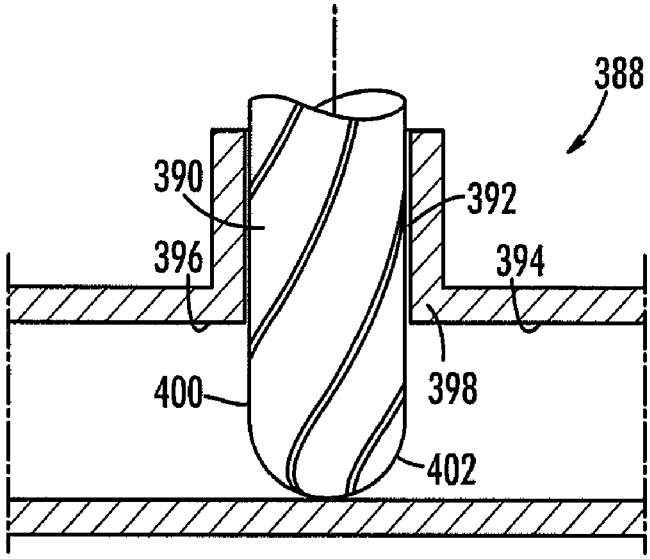
FIG. 37 is a cross sectional view of a prior art breech chamber along with the view of a ball end mill tool as used in manufacturing the breech chamber.

Referring now to FIG. 37, a step in the manufacturing process of a prior art breech chamber 388 is shown using ball end mill 390 plunged into the breech chamber 388 to define through a feed port 392. A breech chamber opening 394 and firing mechanism opening 396 along with the feed port 392 are preferably cylindrical in shape and defined by a breech chamber body 398. The ball end mill 390 includes a cylindrical portion 400 and spherical portion 402 as shown.

Figure 38:
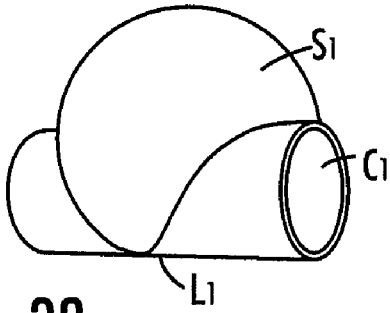
FIG. 38 is a three dimensional view of a cylinder intersecting a sphere.
Figure 39:
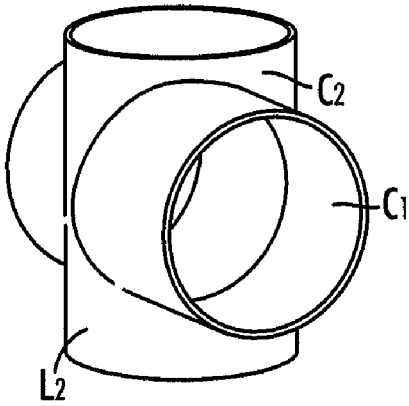
FIG. 39 is a three dimensional view of two cylinders intersecting each other.

FIG. 38 represents a three dimensional view of the sphere Si intersecting a cylinder C1 creating an intersecting curve L1. Now referring to FIG. 39, a similar effect is shown wherein cylinder C1 intersects with another cylinder C2, creating an intersecting curve L2. The scenario presented in FIGS. 38 and 39 can be also applied in FIG. 37 where breech chamber opening 394 and firing mechanism opening 396 intersect with cylindrical portion 400 and spherical portion 402 of the ball end mill 390 creating intersecting curves (rays) as well.

Figure 40:
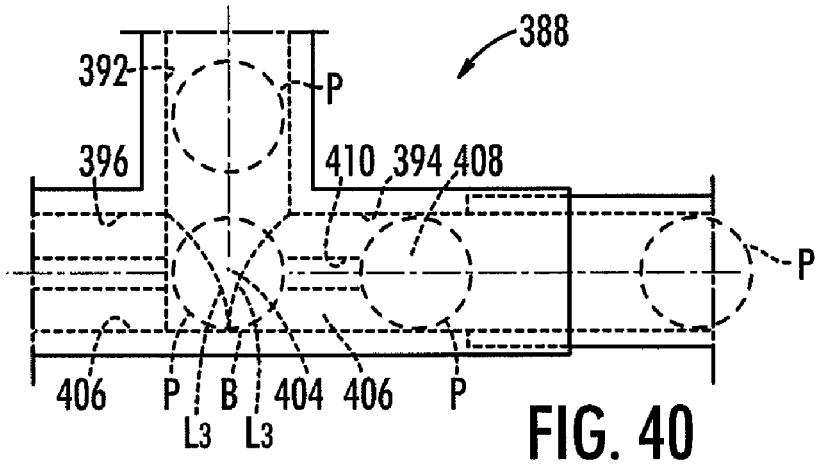
FIG. 40 is a cross-sectional schematic view of a prior art breech chamber with a paintball represented in phantom to show a successful ball loading sequence.

FIG. 40 shows a sequence for a successful loading operation of a paintball P in a prior art breech chamber where first, the paintball drops by the force of gravity or being forced by the feeder (not shown) through the feed port 392 to a breech chamber cavity 404 until the paintball P reaches the bottom portion of the breech chamber cavity B, which is cylindrical in shape. Next, a bolt 406 is activated by a firing mechanism (not separately shown) to load the paintball P into a firing chamber 408 by sliding forward along the breech chamber opening 394 and the firing mechanism opening 396, and than being propelled by compressed gas delivered through a passageway 410. The intersection curves created by manufacturing process described in FIG. 37 are shown and represented by reference L3.

Figure 41:
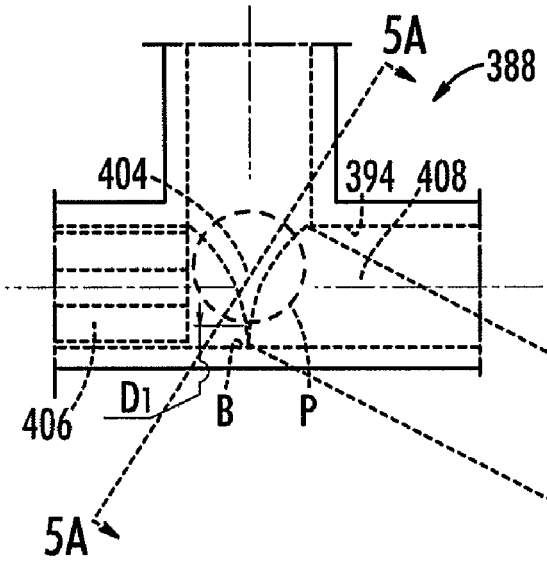
FIG. 41 is a horizontal cross-sectional schematic view of the same prior art breech chamber showing a misaligned paintball being loaded into the firing chamber in that the paintball is offset from the base of the breech chamber cavity.

FIG. 41 is an elevation view of the prior art breech chamber 388 and shows a case of rapid firing wherein the firing cycle is shorter than the paintball loading cycle into the breech chamber cavity 404, which often results in loading paintball into the firing chamber 408 before the paintball can reach the base (or bottom) B of the breech chamber cavity 404. The length D1 represents the offset distance from the base surface of the breech chamber cavity 404 to the nearest point of the paintball P.

Figure 41A:
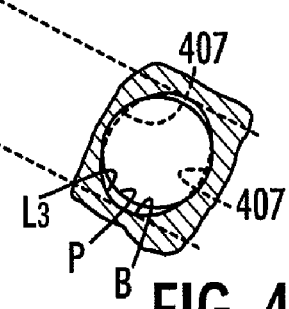
FIG. 41A is vertical cross-sectional view taken along the plane 5A-5A in FIG. 41.

FIG. 41A is a vertical cross-sectional view showing the paintball entry into the firing chamber 408 as described in reference to FIG. 40. Since the intersecting curve L3 is elliptical in shape with the width smaller than the paintball diameter in this particular view, the paintball P overlaps the paintball entry opening as seen with dotted curves 407 preventing paintball P from entering to firing chamber 408. The force generated by the sliding bolt 406 forces the paintball into the firing chamber 408 resulting in paintball breakage.

FIGS. 42 and 42A are a simplified, horizontal cross-sectional view showing the open-path entry of the paintball P into the firing chamber 408 according to an embodiment of the present invention. FIG. 42A is a vertical cross-sectional view of the desirable paintball path which can be defined in a form of the radius comparison in a way that radius R2 of the elbow type paintball path curve should be equal to or greater than radius R1 of the paintball P to provide for unobstructed paintball entry into the firing chamber 408. This can be achieved by selecting a different manufacturing process or by removing material defining the intersecting curves created in a conventional manufacturing process.

FIG. 43 illustrates another drawback in prior-art breech chamber configuration where the diameter of the cylindrical breech cavity 404 is substantially the same as the diameter of the barrel opening 412. Paintballs are not perfectly spherical due to variations cased by the manufacturing process. As shown in 43, an egg shaped paintball P extends a distance D2 over the cylindrical breech chamber opening 394 and when loaded into the firing chamber 408 first touches entry edge E which causes the paintball P to start spinning. Once initiated, the spinning is further promoted and the spinning rate increased when propellant fires the paintball through the barrel. The consequence of a spinning paintball is a curve trajectory. In case of paintball game curved or otherwise variable trajectory is undesirable, since the object of the paintball game is to mark the player, not to avoid him.

Figure 44:
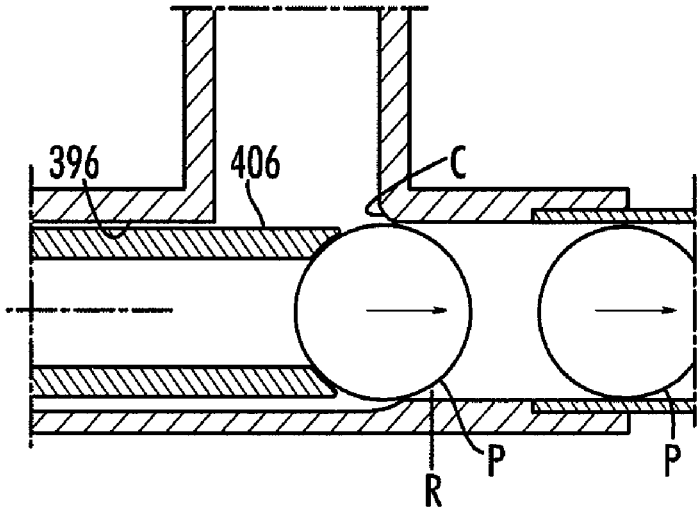
FIG. 44 is a cross sectional view of the breech chamber according to present invention and shows a paintball being loaded into the firing chamber with improved entry path to reduce paintball breakage.

FIG. 44 shows an improved breech chamber according to an embodiment of the present invention with recess R to provide smoother paintball entry into the firing chamber in case the paintball is oversized or out of round. Curve C in a form of a regular chamfer or any other shape improves paintball P entry to even higher degree. These improvements significantly reduce the rate of paintball spinning and subsequently provide straighter trajectory to hit the desired target.

Figure 45:
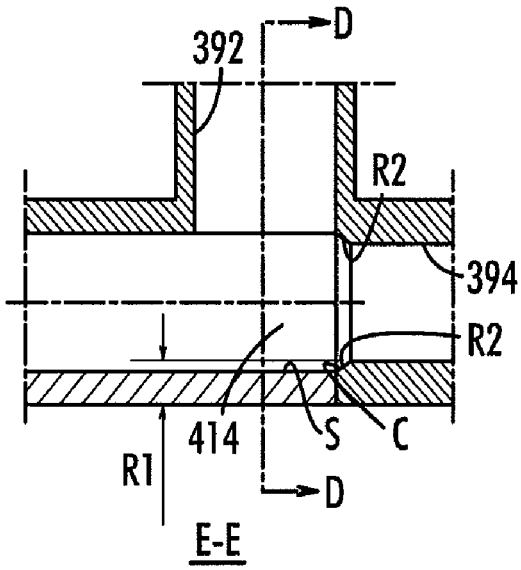
FIG. 45 is a horizontal cross-sectional view of the breech chamber according to present invention shown in cross sectional views.
Figure 45A:
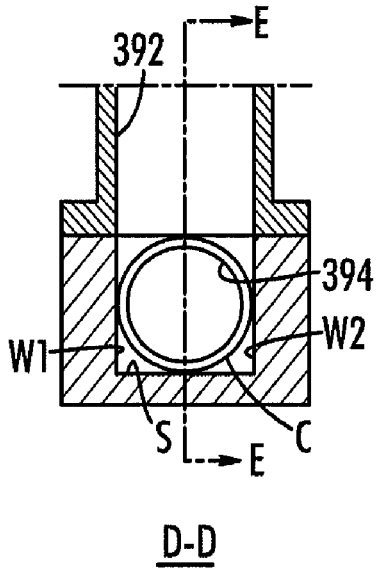
FIG. 45A is vertical cross-sectional view taken along the plane D-D in FIG. 45.

FIGS. 45 and 45A represent an optional alternate to FIGS. 42-43. The breech chamber configuration shown in 45 and 45A addresses the improvements described above in reference to both FIGS. 42 and 44, but reflecting a concern for manufacturability. As described earlier, a paintball drops from the hopper (not separately shown) into the breech cavity 130 through the feed port 12. In the prior art breech chamber cavity is cylindrical in shape as seen in FIG. 42A. In the example presented in FIGS. 45 and 45A, a breech chamber 414 is substantially rectangular in cross-section (i.e., shape) having walls W1 and W2 to prevent the paintball from moving sideways and a bottom surface S for receiving paintball. A rectangular breech chamber can be accomplished by simple manufacturing process and is free from intersecting curves. A circular recess R1 in the form of a chamfer or any other shape and additional radius R2 helps even further for guided paintball entry into the cylindrical firing chamber surface 396. In case the paintball does not reach the surface S during rapid firing, the paintball will slip into the firing chamber when pushed by the bolt 406, since there are no intersecting curves to obstruct entry as shown in FIG. 42.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. An apparatus for propelling a projectile with compressed gas, the apparatus comprising:

a barrel;

a compressed gas source;

a body coupled with the barrel, wherein the body defines a gas storage chamber adapted to be in fluid communication with the compressed gas source and hold a predetermined volume of compressed gas therein;

a receptacle configured to provide a supply of projectiles to the body;

a firing tube into which the gas storage chamber is vented;

a valve arrangement movable between a ready-to-fire position that allows fluid communication between the gas storage chamber and the compressed gas source and a firing position that vents gas from the gas storage chamber to propel projectiles through the barrel, wherein the valve arrangement includes:

a first valve with a proximate end and a distal end, wherein the distal end includes a sealed portion that prevents venting of the gas storage chamber into the firing tube when the valve arrangement is in the ready-to-fire position and allows venting of the gas storage chamber when the valve arrangement is in the firing position, and a second valve that is configured to selectively provide compressed gas to the proximate end of the first valve for moving the valve arrangement between the ready-to-fire position and the firing position;

a firing mechanism for actuating the second valve;

wherein the valve arrangement includes a control passageway adapted to provide fluid communication between the compressed gas source and the proximate end of the first valve, wherein the second valve prevents fluid communication between the control passageway and the compressed gas source when the valve arrangement is in the ready-to-fire position; and wherein the proximate end of the first valve includes a portion into which a biasing member is disposed, wherein the biasing member urges the distal end toward the firing tube, wherein compressed gas flowing through the control passageway overcomes a biasing force of the biasing member to move the distal end away from the firing tube when the valve arrangement is in the firing position.

2. The apparatus of claim 1, wherein the first valve is a spool valve and the second valve is a spool valve.

3. The apparatus of claim 1, wherein the second valve has a reduced length compared to the first valve.

4. The apparatus of claim 1, wherein the second valve has a reduced diameter compared to the first valve.

5. The apparatus of claim 1, wherein the second valve has a reduced travel compared to the first valve.

6. The apparatus of claim 1, wherein the second valve moves about its longitudinal axis.

7. The apparatus of claim 6, wherein the second valve moves substantially about a transverse axis with respect to the first valve.

8. The apparatus of claim 1, wherein the firing mechanism includes a trigger assembly and at least a portion of the trigger assembly contacts a portion of the second valve when a user actuates the trigger assembly.

9. The apparatus of claim 8, wherein at least a portion of the trigger assembly directly contacts a portion of the second valve when a user actuates the trigger assembly.

10. The apparatus of claim 8, wherein at least a portion the second valve moves longitudinally when a user actuates the trigger assembly.

11. The apparatus of claim 10, wherein at least a portion of the trigger assembly moves concomitant with the second valve.

12. The apparatus of claim 1, wherein the sealed portion of the first valve comprises a face seal on the distal end.

13. The apparatus of claim 1, wherein the sealed portion of the first valve comprises an O-ring on the distal end.

14. The apparatus of claim 1, wherein the sealed portion of the first valve includes an O-ring disposed within the firing tube into which the distal end extends when the valve arrangement is in the ready-to-fire position.

15. The apparatus of claim 1, wherein the distal end of the first valve moves away from the firing tube when the valve arrangement moves from the ready-to-fire position to the firing position.

16. The apparatus of claim 1, wherein the first valve moves toward the gas storage chamber when the valve arrangement moves from the ready-to-fire position to the firing position.

17. The apparatus of claim 1, wherein the first valve includes a reduced dimension portion that permits flow from the compressed gas source to the gas storage chamber when the valve arrangement is in the ready-to-fire position.

18. The apparatus of claim 1, wherein the valve arrangement includes a longitudinally-extending passageway that provides fluid communication between the gas storage chamber and the firing tube when the valve arrangement is in the firing position.

19. The apparatus of claim 18, wherein the passageway provides fluid communication between the gas storage chamber and the compressed gas source when the valve arrangement is in the ready-to-fire position.

20. The apparatus of claim 19, wherein the valve arrangement includes an entry port that provides fluid communication between the passageway and the compressed gas source when the valve arrangement is in the ready-to-fire position.

21. The apparatus of claim 20, wherein the entry port extends transversely with respect to the passageway.

22. An apparatus for propelling a projectile with compressed gas, the apparatus comprising:

a barrel;

a compressed gas source;

a body coupled with the barrel, wherein the body defines a gas storage chamber adapted to be in fluid communication with the compressed gas source and hold a predetermined volume of compressed gas therein;

a firing tube into which the gas storage chamber is vented;

a receptacle configured to provide a supply of projectiles to the body;

a first valve movable between an open position and a closed, wherein the first valve has a proximate end and a distal end, wherein the distal end includes a sealed portion that prevents venting of the gas storage chamber into the firing tube when the first valve is in the closed position and allows venting of the gas storage chamber when the first valve is in the open position, and a second valve movable between a ready-to-fire position and a firing position, wherein the second valve controls fluid communication between the compressed gas source and a portion of the first valve when in the ready-to-fire position and allows fluid communication between the compressed gas source and the portion of the first valve when in the firing position;

a firing mechanism configured to move the second arrangement from the ready-to-fire position to the firing position, wherein the firing mechanism includes a trigger and an electronic switch configured to detect movement of the trigger;

wherein the firing mechanism includes a linear actuator movable between a first position and a second position responsive to the electronic switch; and wherein the firing mechanism includes a sear-like mechanism disposed between the linear actuator and the second valve.

23. The apparatus of claim 22, wherein the sear-like mechanism has a first end adjacent to the second valve and a second end adjacent to the linear actuator.

24. The apparatus of claim 23, wherein movement of the linear actuator from the first position to the second position moves the sear-like mechanism from a third position to a fourth position.

25. The apparatus of claim 24, wherein the sear-like mechanism rotates between the third position and the fourth position.

26. The apparatus of claim 22, wherein the switch is a contact switch.

27. The apparatus of claim 22, wherein the switch includes a Hall effect sensor.

* * * * *